US009166265B2

(12) United States Patent
Fukunaga

(10) Patent No.: US 9,166,265 B2
(45) Date of Patent: Oct. 20, 2015

(54) SIGNAL TRANSMISSION DEVICE, FILTER, AND INTER-SUBSTRATE COMMUNICATION DEVICE

(71) Applicant: TDK CORPORATION, Tokyo (JP)

(72) Inventor: Tatsuya Fukunaga, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/331,900

(22) Filed: Jul. 15, 2014

(65) Prior Publication Data

US 2014/0340175 A1 Nov. 20, 2014

Related U.S. Application Data

(63) Continuation of application No. 13/221,525, filed on Aug. 30, 2011, now Pat. No. 8,810,338.

(30) Foreign Application Priority Data

Aug. 31, 2010 (JP) ..... 2010-194558
Nov. 30, 2010 (JP) ..... 2010-267139

(51) Int. Cl.
*H01P 3/08* (2006.01)
*H01P 1/20* (2006.01)
*H01P 1/203* (2006.01)

(52) U.S. Cl.
CPC ..... *H01P 1/20* (2013.01); *H01P 1/20327* (2013.01); *H01P 1/20345* (2013.01)

(58) Field of Classification Search
CPC .... H01P 1/20; H01P 1/20327; H01P 1/20345
USPC ..... 333/165–168, 185, 202–204
See application file for complete search history.

(56) References Cited

U.S. PATENT DOCUMENTS 6,130,591 A 10/2000 Tsuzuki
7,652,548 B2 1/2010 Yoshikawa et al.
2007/0205851 A1 9/2007 Fukunaga

FOREIGN PATENT DOCUMENTS

JP A-09-232822 9/1997
JP A-11-68403 3/1999

(Continued)

OTHER PUBLICATIONS

Kurs et al., "Wireless Power Transfer via Strongly Coupled Magnetic Resonances," *Science*, 2007, vol. 317, pp. 83-86.

*Primary Examiner* — Robert Pascal
*Assistant Examiner* — Kimberly Glenn
(74) *Attorney, Agent, or Firm* — Oliff PLC

(57) ABSTRACT

A signal transmission device includes substrates and resonance sections resonating at the predetermined resonance frequency. At least one of the substrates is formed with two or more resonators in the second direction, and the remaining one or two or more of the substrates are each formed with one or more resonators in the second direction, and at least one of the resonance sections is configured by a plurality of resonators opposing one another in the first direction between the substrates, the opposing resonators form a coupled resonator resonating as a whole at the predetermined resonance frequency through electromagnetic coupling in a hybrid resonance mode, and in a state that the substrates are separated away from one another to fail to establish electromagnetic coupling thereamong, the resonators forming the coupled resonator resonate at any other resonance frequency different from the predetermined resonance frequency on the substrate basis.

9 Claims, 22 Drawing Sheets

(56) References Cited

FOREIGN PATENT DOCUMENTS

| | | |
|---|---|---|
| JP | A-2001-523412 | 11/2001 |
| JP | A-2002-185206 | 6/2002 |
| JP | A-2007-235857 | 9/2007 |
| JP | A-2008-067012 | 3/2008 |
| JP | A-2008-103830 | 5/2008 |
| JP | A-2008-271606 | 11/2008 |
| JP | A-2010-206319 | 9/2010 |
| JP | A-2010-206320 | 9/2010 |
| WO | WO 98/48473 A1 | 10/1998 |

SIGNAL TRANSMISSION DEVICE, FILTER, AND INTER-SUBSTRATE COMMUNICATION DEVICE

This is a Continuation Application of application Ser. No. 13/221,525 filed Aug. 30, 2011. The disclosure of the prior application is hereby incorporate by reference herein in its entirety.

BACKGROUND

The present disclosure relates to a signal transmission device, a filter, and an inter-substrate communication device that perform transmission of signals (electromagnetic waves) using a plurality of substrates each formed with a resonator.

A previously known transmission device performs transmission of signals (electromagnetic waves) through electromagnetic coupling of a plurality of resonators. As an example, "Wireless Power Transfer via Strongly Coupled Magnetic Resonances", (Science vol. 317, pp. 83-86, 2007-6) describes a method of implementing a wireless power transmission system through electromagnetic coupling of coils utilizing a phenomenon of resonance. The coils for electromagnetic coupling include one at the power transmission end and another at the power reception end, which are both in the form of spiral and are positioned in the air. In such a power transmission system, the power-transmission coil and the power-reception coil are each provided with a loop conductor for excitation use. The loop conductor at the power transmission end is connected with a high-frequency power supply circuit for supply of power, and the loop conductor at the power reception end is connected with a device that becomes a load.

SUMMARY

In the wireless power transmission system described above, the coils, i.e., the power-transmission coil and the power-reception coil, and their loop conductors for excitation use share the same resonance frequency f0 for resonance. Basically, these power-transmission and reception coils operate as a two-stage BPF (Band-Pass Filter) whose passband is the resonance frequency f0. In such a power transmission system, as for the power-transmission and power-reception coils, their individual band of resonance frequency when there is no electromagnetic coupling therebetween is included in the band of the resonance frequency f0 when the coils are in electromagnetic coupling. Therefore, even if the power-transmission and power-reception coils are not in electromagnetic coupling, power radiation comes from the power-transmission coil. When transmission of signals is to be performed with the principles similar to those of the power transmission system as above, there arises a disadvantage of leakage of signals (electromagnetic waves).

It is desirable to provide a signal transmission device, a filter, and an inter-substrate communication device that are capable of preventing any leakage of signals (electromagnetic waves).

A signal transmission device according to a first embodiment of the present disclosure includes a plurality of substrates, and a plurality of resonance sections. The resonance sections are in a parallel arrangement along a second direction different from a first direction along which the substrates are opposing one another. Any of the resonance sections adjacent to each other perform signal transmission in a predetermined passband including a predetermined resonance frequency through electromagnetic coupling therebetween by each resonating at the predetermined resonance frequency.

At least one of the substrates is formed with two or more resonators in the second direction, and the remaining one or two or more of the substrates are each formed with one or more resonators in the second direction.

At least one of the resonance sections is configured by a plurality of resonators opposing one another in the first direction between the substrates, the opposing resonators form a coupled resonator resonating as a whole at the predetermined resonance frequency through electromagnetic coupling in a hybrid resonance mode, and in a state that the substrates are separated away from one another to fail to establish electromagnetic coupling thereamong, the resonators forming the coupled resonator resonate at any other resonance frequency different from the predetermined resonance frequency on the substrate basis.

A filter according to an embodiment of the present disclosure is in the configuration similar to that of the above-described signal transmission device in the first embodiment of the present disclosure, and is operated as a filter.

An inter-substrate communication device according to an embodiment of the present disclosure is, in the configuration of the above-described signal transmission device according to the first embodiment of the present disclosure, further provided with first and second input/output terminals. The first input/output terminal is connected directly physically at least to a first resonator in at least one of the substrates, or is electromagnetically coupled to the first resonator with a spacing therefrom. The second input/output terminal is connected directly physically to another resonator in at least any one of the substrates other than the substrate formed with the first resonator, or is electromagnetically coupled to the other resonator with a spacing therefrom. In the state that the substrates are opposing one another in the first direction, signal transmission is performed between the substrates.

In the signal transmission device, the filter, or the inter-substrate communication device according to the first embodiment of the present disclosure, in the state that a plurality of substrates are opposing one another in the first direction, a plurality of resonance sections are disposed in parallel to one another in a direction different from the first direction, i.e., second direction. Any of the resonance sections adjacent to each other perform signal transmission therebetween in a predetermined passband including a predetermined resonance frequency through electromagnetic coupling therebetween by each resonating at the predetermined resonance frequency. In at least one of the resonance sections, a plurality of resonators form a piece of coupled resonator through electromagnetic coupling thereamong in a hybrid resonance mode. The resulting coupled resonator resonates as a whole at the predetermined resonance frequency. In the state that a plurality of substrates are separated away from each other to fail to establish electromagnetic coupling thereamong, the resonators forming the coupled resonator resonate at any other resonance frequency different from the predetermined resonance frequency on the substrate basis.

That is, the frequency response in the state that the substrates are separated away from one another to fail to establish electromagnetic coupling thereamong is different from the frequency response in the state that the substrates are electromagnetically coupled to one another. Accordingly, in the state that a plurality of substrates are electromagnetically coupled to one another, signal transmission is performed in a predetermined passband including a predetermined resonance frequency. On the other hand, in the state that the substrates are separated away from one another to fail to establish electromagnetic coupling thereamong, signal transmission is not performed in the predetermined passband.

In the signal transmission device or the filter according to the first embodiment of the present disclosure, alternatively, first and second input/output terminals may be further provided, and in the state that a plurality of substrates are opposing one another in the first direction, signal transmission may be performed between the substrates or in each of the substrates. Herein, the first input/output terminal is connected directly physically at least to a first resonator configuring a first resonance section among a plurality of resonance sections, or is electromagnetically coupled to the first resonator with a spacing therefrom. The second input/output terminal is connected directly physically at least to another resonator configuring any of the resonance sections other than the first resonance section, or is electromagnetically coupled to the other resonator with a spacing therefrom.

Further, in the signal transmission device, the filter, or the inter-substrate communication device according to the first embodiment of the present disclosure, still alternatively, the first input/output terminal may be connected with a filter member that allows passage of signals of a predetermined passband, and interrupts passage of signals of any other resonance frequency out of a range of the predetermined passband.

Still further, in the signal transmission device, the filter, or the inter-substrate communication device according to the first embodiment of the present disclosure, still alternatively, in the state that the substrates are separated away from one another to fail to establish electromagnetic coupling thereamong, the resonators forming a coupled resonator may all resonate at the other resonance frequency on the substrate basis.

Still alternatively, in any of the substrates formed with two or more resonators in the second direction, the resonators adjacent to each other may resonate at each different resonance frequency when no electromagnetic coupling is established.

Still further, in the signal transmission device, the filter, or the inter-substrate communication device according to the first embodiment of the present disclosure, still alternatively, among the resonance sections, the first and second resonance sections may form a coupled resonator, and the resonators configuring the first resonance section and the other resonators configuring the second resonance section may be formed in the two or more substrates in a same combination.

Still alternatively, among the resonance sections, the first and second resonance sections may form a coupled resonator, and the first and second resonance sections may be adjacent to each other in the second direction. The resonators configuring the first resonance section and the other resonators configuring the second resonance section may be formed in the substrates in a partially different combination.

A signal transmission device according to a second embodiment of the present disclosure includes a plurality of substrates, a resonator formed to each of the substrates, a coupled resonator, and a filter member. The coupled resonator is formed, in the state that the substrates are opposing one another in a first direction, by electromagnetic coupling among the opposing resonators in a hybrid resonance mode, and the coupled resonator resonates as a whole at a predetermined resonance frequency. The filter member is provided to the resonator formed to at least one of the substrates, and the filter member allows passage of signals of a predetermined passband including the predetermined resonance frequency between the coupled resonator. In the state that the substrates are separated away from one another to fail to establish electromagnetic coupling thereamong, the resonators forming the coupled resonator resonate at any other resonance frequency different from the predetermined resonance frequency on the substrate basis, and the filter member interrupts passage of signals of the other resonance frequency out of a range of the predetermined passband.

In the signal transmission device according to the second embodiment of the present disclosure as such, in the state that a plurality of substrates are opposing one another in the first direction, a plurality of resonators form a coupled resonator resonating as a whole at a predetermined resonance frequency by electromagnetic coupling thereamong in a hybrid resonance mode. In the state that the substrates are separated away from one another to fail to establish electromagnetic coupling thereamong, the resonators forming the coupled resonator resonate at any other resonance frequency different from the predetermined resonance frequency on the substrate basis. That is, the frequency response in the state that the substrates are separated away from one another to fail to establish electromagnetic coupling thereamong is different from the frequency response in the state that the substrates are electromagnetically coupled to one another. Accordingly, in the state that a plurality of substrates are electromagnetically coupled to one another, signal transmission is performed in a predetermined passband including a predetermined resonance frequency. On the other hand, in the state that the substrates are separated away from one another to fail to establish electromagnetic coupling thereamong, signal transmission is not performed in the predetermined passband.

Moreover, irrespective of whether a plurality of substrates are opposing one another or not, in at least one of the substrates, the filter member interrupts passage of signals of any other resonance frequency out of a range of a predetermined passband. Accordingly, in the state that the substrates are separated away from one another to fail to establish electromagnetic coupling thereamong, no signal transmission is performed not only in the predetermined passband but also with the other resonance frequency out of a range of the predetermined passband.

Note that, in the signal transmission device, the filter, or the inter-substrate communication device according to the first or second embodiment of the present disclosure, the expression of "signal transmission" includes not only signal transmission such as transmission/reception of analog and digital signals but also power transmission such as transmission/reception of power.

In the signal transmission device, the filter, or the inter-substrate communication device according to the first or second embodiment of the present disclosure, a piece of coupled resonator resonating as a whole at a predetermined resonance frequency is formed by electromagnetic coupling among a plurality of resonators in a hybrid resonance mode. In the state that a plurality of substrates are separated away from one another to fail to establish electromagnetic coupling thereamong, the resonators forming the coupled resonator resonate at any other resonance frequency different from the predetermined resonance frequency on the substrate basis. Accordingly, the frequency response in the state that the substrates are separated away from one another to fail to establish electromagnetic coupling thereamong becomes different from the frequency response in the state that the substrates are electromagnetically coupled to one another. As such, in the state that a plurality of substrates are electromagnetically coupled to one another, signal transmission is performed in a predetermined passband including a predetermined resonance frequency. On the other hand, in the state that the substrates are separated away from one another to fail to establish electromagnetic coupling thereamong, signal transmission is not performed in the predetermined passband. Therefore, in the state that the substrates are separated away from each other, any leakage of signals (electromagnetic waves) from the resonators formed to the substrates is to be prevented.

Especially, in the signal transmission device according to the second embodiment of the present disclosure, in at least one of the substrates, the filter member is so configured as to interrupt passage of signals of any other resonance frequency out of a range of a predetermined passband. Accordingly, in the state that the substrates are separated away from one another to fail to establish electromagnetic coupling thereamong, no signal transmission is performed not only in the predetermined passband but also with the other resonance frequency out of a range of the predetermined passband. This favorably prevents any leakage of signals (electromagnetic waves) with more effect.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION

In the below, embodiments of the present disclosure are described in detail by referring to the accompanying drawings.

First Embodiment (Exemplary Entire Configuration of Signal Transmission Device)

Figure 1:
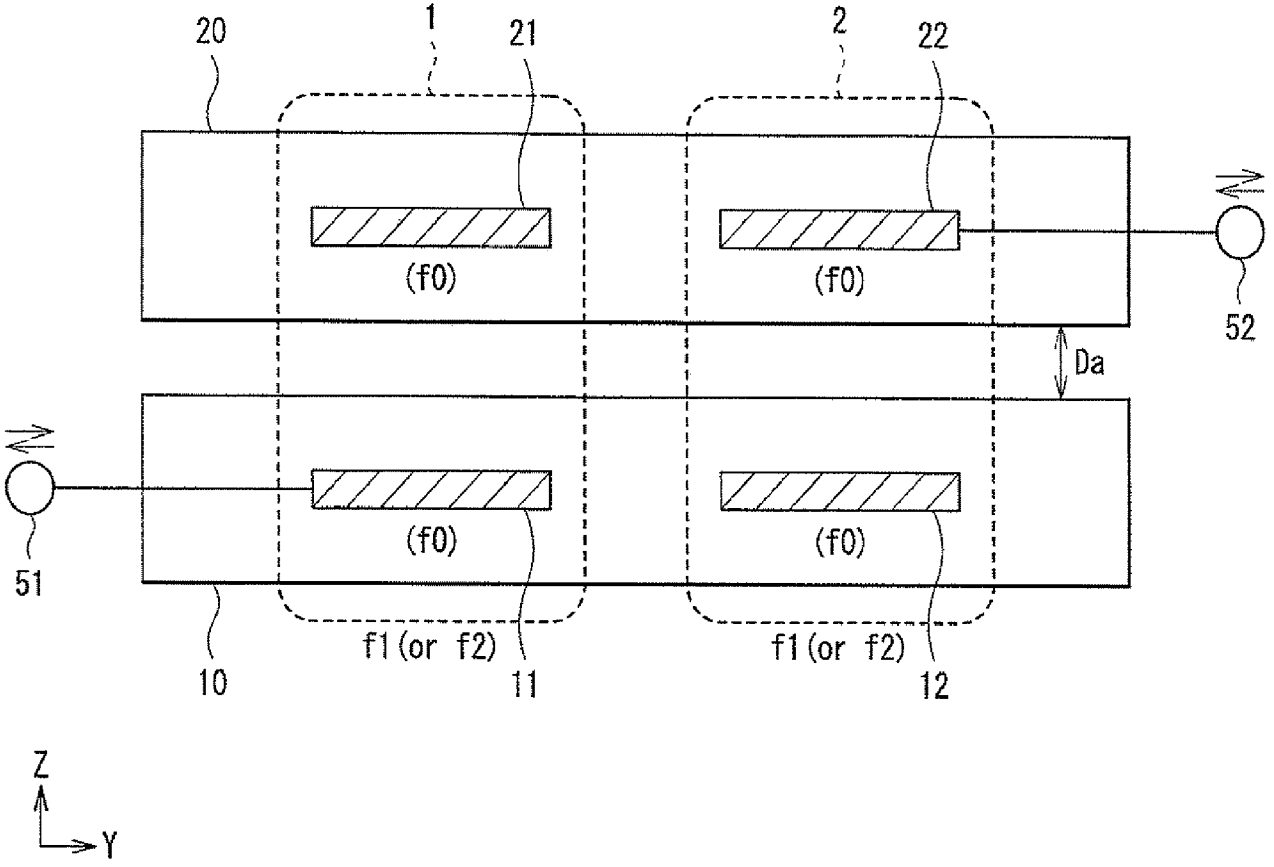
FIG. 1 is a cross-sectional view of a signal transmission device (a filter or an inter-substrate communication device) in a first embodiment of the present disclosure, showing an exemplary configuration thereof together with a resonance frequency of each substrate component.

FIG. 1 is a diagram showing an exemplary entire configuration of a signal transmission device (an inter-substrate communication device or a filter) in a first embodiment of the present disclosure. The signal transmission device in this embodiment is configured to include a first substrate 10 and a second substrate 20, which are disposed to oppose each other in a first direction, i.e., Z direction in the drawing. This signal transmission device is also provided with a first input/output terminal 51 and a second input/output terminal 52. The first and second substrates 10 and 20 are each a dielectric substrate, and are disposed to oppose each other with a layer sandwiched therebetween with a spacing, i.e., inter-substrate distance Da. This layer is made of a material different from the material of the substrates (layer different in permittivity therefrom, e.g., air layer).

The first substrate 10 is formed with first and second resonators 11 and 12 in parallel to each other in a second direction, i.e., Y direction in the drawing. The second substrate 20 is formed with first and second resonators 21 and 22 in parallel to each other also in the second direction. The first and second resonators 11 and 12 in the first substrate 10 are of various types as shown in FIGS. 7 to 16 that will be described later. For example, the resonators may be of a line resonator with a line electrode pattern, e.g., $\lambda/4$ resonator (¼ wavelength resonator), $\lambda/2$ resonator (½ wavelength resonator), $3\lambda/4$ resonator (¾ wavelength resonator), or $\lambda$ resonator (1 wavelength resonator). This is applicable also to the first and second resonators 21 and 22 in the second substrate 20. Note that FIG. 1 shows an exemplary case in which the resonators 11, 12, 21, and 22 are formed inside of the respective substrates. Alternatively, the resonators 11, 12, 21, and 22 may be formed like strip lines on the surface (or on the underside) of the respective substrates 10 and 20.

In this signal transmission device, in the state that the first and second substrates 10 and 20 are opposing each other in the first direction, electromagnetic coupling is established between the resonators opposing each other in the first direction, i.e., the first resonator 11 in the first substrate 10 and the first resonator 21 in the second substrate 20, thereby forming a first resonance section 1. Also in the state that the first and second substrates 10 and 20 are opposing each other in the first direction, electromagnetic coupling is established between the resonators opposing each other in the first direction, i.e., the second resonator 12 in the first substrate 10 and the second resonator 22 in the second substrate 20, thereby forming a second resonance section 2. As such, in the state that the first and second substrates 10 and 20 are opposing each other in the first direction, the first and second resonance sections 1 and 2 are disposed in parallel to each other in the second direction.

The first and second resonance sections 1 and 2 are each so configured as to be in electromagnetic coupling by each resonating at a predetermined resonance frequency, i.e., first or second resonance frequency f1 or f2 in a hybrid resonance mode that will be described later. Between the first and second resonance sections 1 and 2, signal transmission is to be performed in a predetermined passband including the predetermined resonance frequency. On the other hand, in the state that the first and second substrates 10 and 20 are separated away from each other so as not to or fail to establish electromagnetic coupling therebetween, the resonators 11, 12, 22, and 21 respectively forming the first and second resonance sections 1 and 2 are supposed to resonate not at the predetermined resonance frequency but at any other resonance frequency, i.e., resonance frequency f0.

Between the first resonator 11 in the first substrate 10 and the first resonator 21 in the second substrate 20, electromagnetic coupling (magnetic-field coupling) is preferably established mainly by magnetic-field components via an air layer, for example. Similarly, between the second resonator 12 in the first substrate 10 and the second resonator 22 in the second substrate 20, electromagnetic coupling (magnetic-field coupling) is preferably established mainly by magnetic-field components. The electromagnetic coupling established mainly by the electromagnetic components as such almost prevents any electric-field distribution in the air layer or others between the first and second substrates 10 and 20. Accordingly, even if there is any change of the inter-substrate distance Da such as air layer or others between the first and second substrates 10 and 20, the first and second resonance sections 1 and 2 are prevented from varying in resonance frequency. As a result, this prevents any variation of passing frequency and the passband to be caused by the change of the inter-substrate distance Da.

The first input/output terminal 51 is connected directly physically to the first resonator 11 in the first substrate 10, i.e., electrical continuity is directly established therebetween. With this configuration, signal transmission is expected to be performed between the first input/output terminal 51 and the first resonance section 1. The second input/output terminal 52 is connected directly physically to the second resonator 22 in the second substrate 20, i.e., electrical continuity is directly established therebetween. With this configuration, signal transmission is expected to be performed between the second input/output terminal 52 and the second resonance section 2. Because the first and second resonance sections 1 and 2 are electromagnetically coupled to each other, signal transmission is expected to be performed between the first and second input/output terminals 51 and 52. As such, in the state that the first and second substrates 10 and 20 are opposing each other in the first direction, signal transmission is expected to be performed between the two substrates, i.e., the first and second substrates 10 and 20.

(Operation and Effects)

With such a signal transmission device, in the first resonance section 1, the first resonator 11 in the first substrate 10 and the first resonator 21 in the second substrate 20 both configure a piece of coupled resonator through electromagnetic coupling therebetween in the hybrid resonance mode that will be described later. The resulting coupled resonator resonates, as a whole, at the predetermined first resonance frequency f1 (or the second resonance frequency f2). In the state that the first and second substrates 10 and 20 are separated away enough from each other so as not to establish electromagnetic coupling therebetween, the first resonator 11 in the first substrate 10 and the first resonator 21 in the second substrate 20 both do not resonate at the predetermined first resonance frequency f1 (or the second resonance frequency f2) but at any other resonance frequency, i.e., resonance frequency f0.

Similarly, in the second resonance section 2, the second resonator 12 in the first substrate 10 and the second resonator 22 in the second substrate 20 both configure a piece of coupled resonator through electromagnetic coupling therebetween in the hybrid resonance mode that will be described later. The resulting coupled resonator resonates, as a whole, at the predetermined first resonance frequency f1 (or the second resonance frequency f2). In the state that the first and second substrates 10 and 20 are separated away enough from each other so as not to establish electromagnetic coupling therebetween, the second resonator 21 in the first substrate 10 and the second resonator 21 in the second substrate 20 both do not resonate at the predetermined first resonance frequency f1 (or the second resonance frequency f2) but at any other resonance frequency, i.e., resonance frequency f0.

As such, the frequency response in the state that the first and second substrates 10 and 20 are separated away enough from each other so as not to establish electromagnetic coupling therebetween is different from the frequency response in the state that the first and second substrates 10 and 20 are electromagnetically coupled to each other. Accordingly, in the state that the first and second substrates 10 and 20 are electromagnetically coupled to each other, for example, signal transmission is performed in a predetermined passband including the first resonance frequency f1 (or the second resonance frequency f2). On the other hand, in the state that the first and second substrates 10 and 20 are separated away enough from each other so as not to establish electromagnetic coupling therebetween, signal transmission is not performed in the predetermined passband including the first resonance frequency f1 (or the second resonance frequency f2) because the substrates 10 and 20 each resonate at the resonance frequency f0. As such, in the state that the first and second substrates 10 and 20 are separated away enough from each other, even if signals of a band same as that of the first resonance frequency f1 (or of the second resonance frequency f2) are input, the signals are to be reflected, thereby being able to prevent any leakage of signals (electromagnetic waves) from the resonators 11, 12, 21, and 22.

(Principles of Signal Transmission in Hybrid Resonance Mode)

Figure 2:
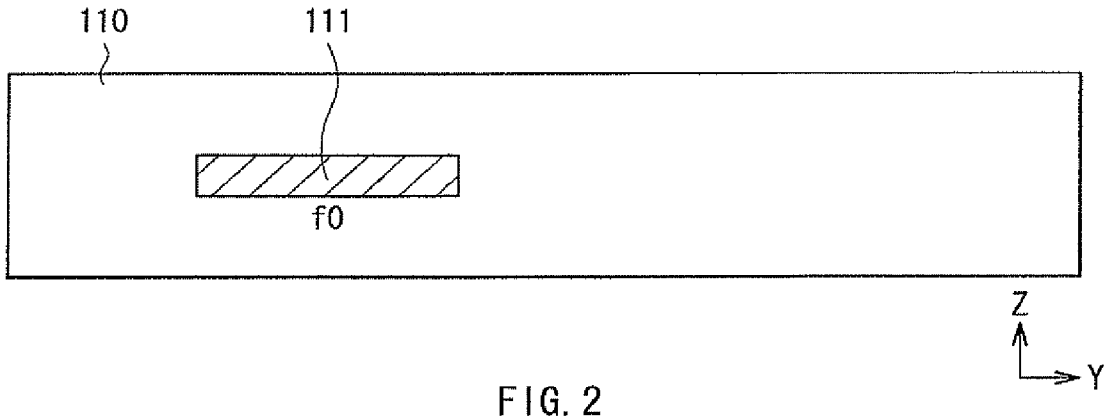
FIG. 2 RELATED ART
FIG. 2 is a cross-sectional view of a substrate having the resonator configuration of a comparative example.
Figure 3:
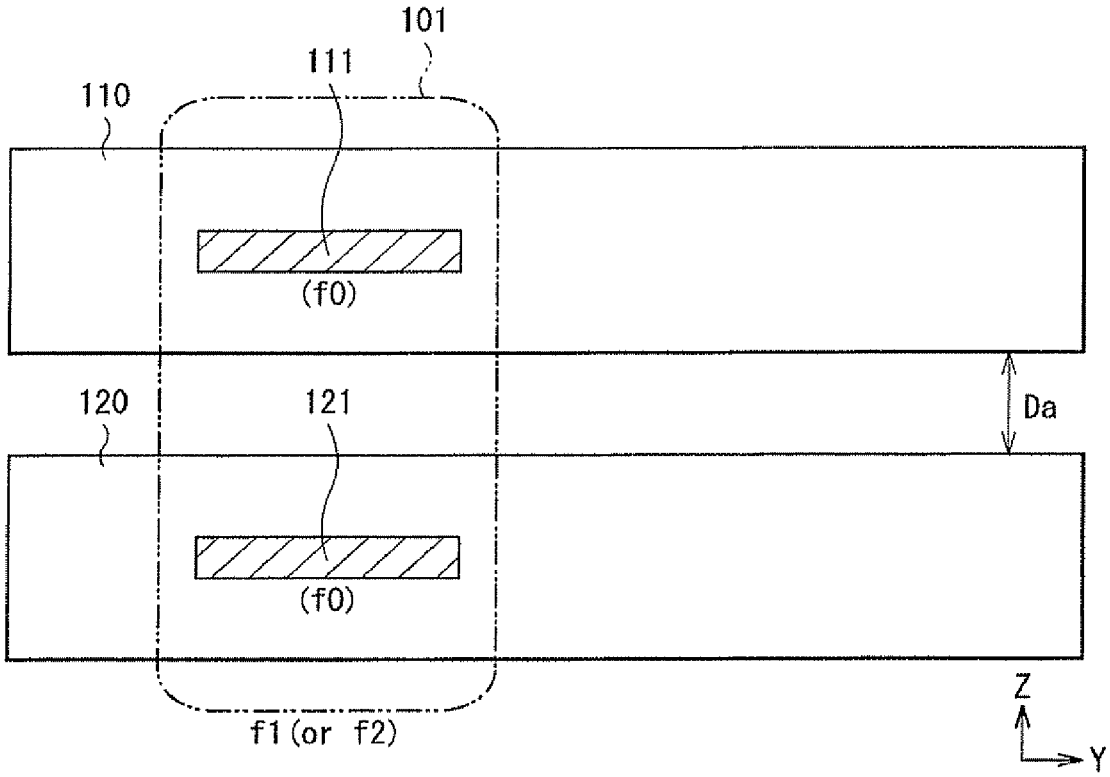
FIG. 3 is a diagram showing the cross-sectional configuration in which two of the substrate of FIG. 2 are disposed to oppose each other.
Figures 4A, 4B:
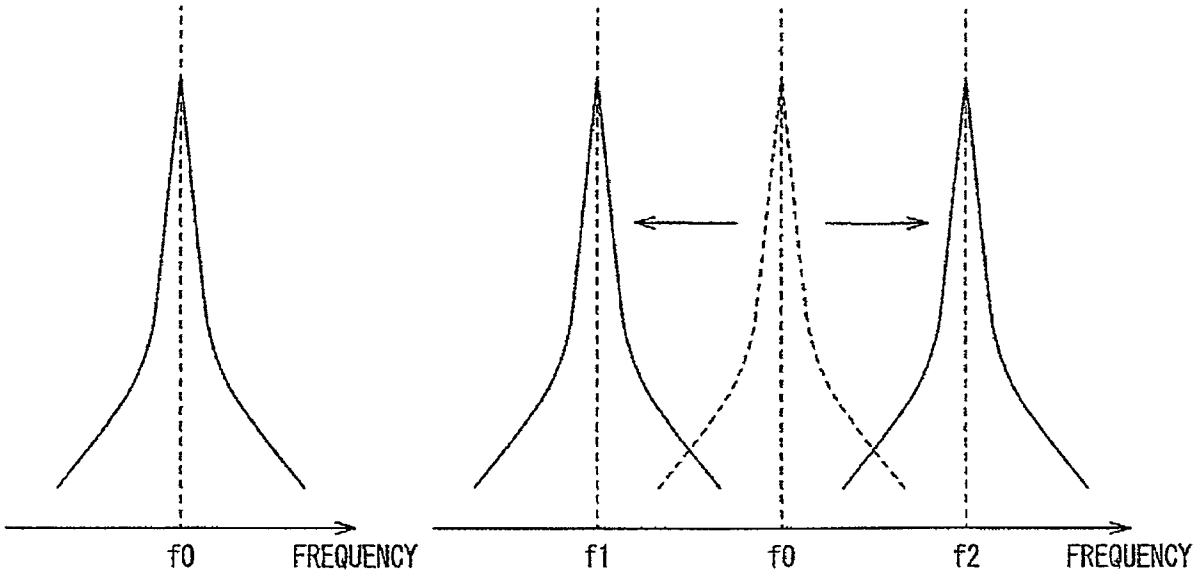
FIG. 4A is a diagram illustrating the resonance frequency of a resonator.
FIG. 4B is a diagram illustrating the resonance frequencies of two resonators.

Described now are principles of signal transmission in the hybrid resonance mode described above. For the sake of brevity, as a resonator configuration in a comparative example, exemplified herein is a configuration in which a first substrate 110 is formed therein with a piece of resonator 111 as shown in FIG. 2. With the resonator configuration as such in the comparative example, as shown in FIG. 4A, the resonator is operated in a resonance mode of resonating at one resonance frequency f0. For a comparison, as shown in FIG. 3, exemplified is a case in which a second substrate 120 is disposed to oppose the first substrate 110 with the inter-substrate distance Da therebetween, and the first and second substrates 110 and 120 are electromagnetically coupled to each other. Herein, the second substrate 120 is configured similarly to the resonator configuration of FIG. 2 in the comparative example. The second substrate 120 is formed therein with a piece of resonator 121. The resonator 121 in the second substrate 120 is configured similarly to the resonator 111 in the first substrate 110. Therefore, when the second substrate 120 is not in electromagnetic coupling with the first substrate 110, as shown in FIG. 4A, the resonator 121 is in a resonance mode of resonating only at a specific one resonance frequency f0. However, in the state of FIG. 3, i.e., the two resonators 111 and 121 are electromagnetically coupled to each other, due to the hopping effect of radio waves, the resonators do not resonate at one resonance frequency f0 like when no electromagnetic coupling is established but resonate in the hybrid resonance mode as shown in FIG. 4B. The hybrid resonance mode is a mixture of a first resonance mode of resonating at the first resonance frequency f1 lower than the resonance frequency f0, and a second resonance mode of resonating at the second resonance frequency f2 higher than the resonance frequency f0.

Assuming that the two resonators 111 and 121 to be in electromagnetic coupling in the hybrid resonance mode of FIG. 3 are a single piece of coupled resonator 101, a parallel arrangement of the similar resonator configuration may configure a filter whose passband includes a band of the first resonance frequency f1 (or of the second resonance frequency f2). Any input of signals of a frequency around the first resonance frequency f1 (or the second resonance frequency f2) enables signal transmission. The signal transmission device in the embodiment of FIG. 1 has such a configuration.

Figure 5:
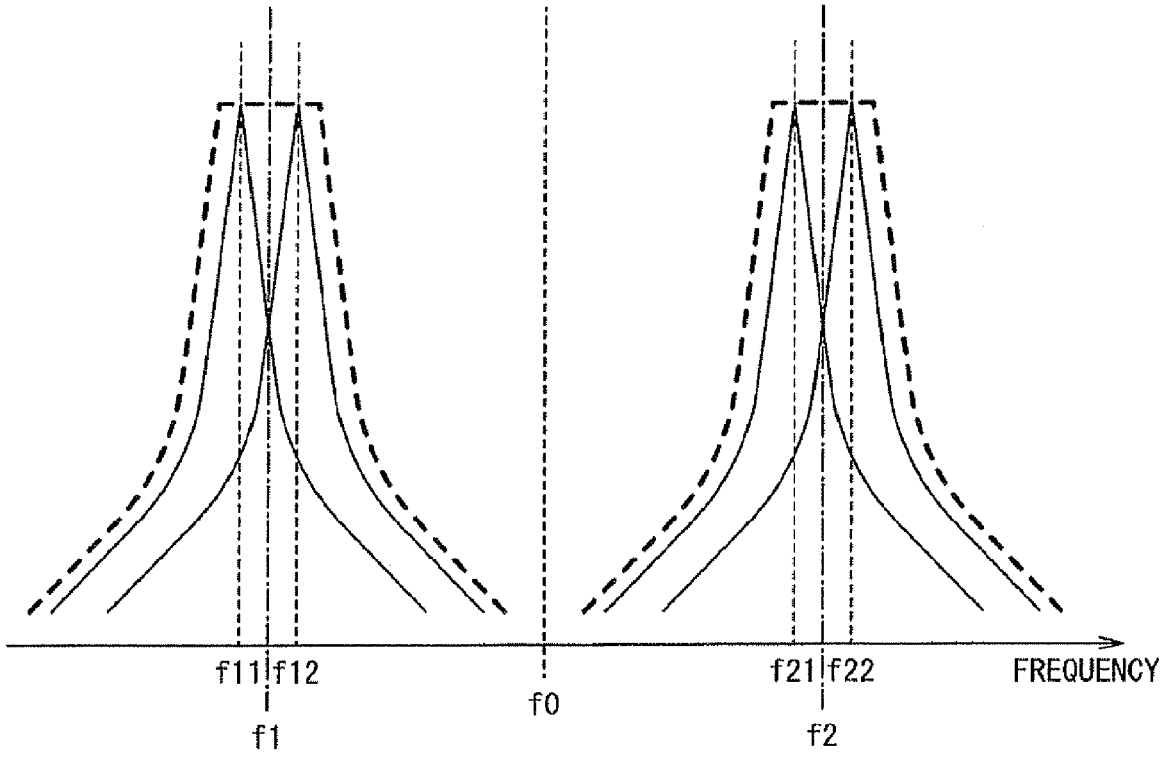
FIG. 5 is a diagram illustrating the resonance frequency in the configuration of including two coupled resonators disposed in parallel to each other.

Based on the principles as above, the resonance mode in the signal transmission device in the embodiment is described in more detail. The first and second resonance sections 1 and 2 of FIG. 1 are both in the configuration similar to that of the coupled resonator 101 of FIG. 3. Therefore, when no electromagnetic coupling is established, these resonance sections 1 and 2 thus resonate at the first and second resonance frequencies f1 and f2 as shown in FIG. 4B. However, because the first and second resonance sections 1 and 2 are disposed in parallel to each other and are electromagnetically coupled to each other, the first and second resonance frequencies f1 and f2 each have two peaks as shown in FIG. 5. That is, on the frequency side lower than the resonance frequency f0, the peak of the resonance frequency is at a resonance frequency f11 lower than the first resonance frequency f1, and at a resonance frequency f12 higher than the first resonance frequency f1. On the frequency side higher than the resonance frequency f0, the peak of the resonance frequency is at a resonance frequency f21 lower than the second resonance frequency f2, and at a resonance frequency f22 higher than the second resonance frequency f2. In this case, on the frequency side lower than the resonance frequency f0, a predetermined passband of a specific bandwidth is formed in a range around the first resonance frequency f1, i.e., in a range from the resonance frequency f11 to the resonance frequency f12. On the frequency side higher than the resonance frequency f0, a predetermined passband of a specific bandwidth is formed in a range around the second resonance frequency f2, i.e., in a range from the resonance frequency f21 to the resonance frequency f22. The passband herein denotes the range showing the passing characteristics lower by 3 dB than the maximum value thereof. Such a definition of the passing characteristics is applicable also to any other exemplary configurations to be described later by referring to FIG. 17 and others. In the signal transmission device in this embodiment and those in other exemplary configurations, the passband for signals defined as above does not include the resonance frequency f0.

Figure 6:
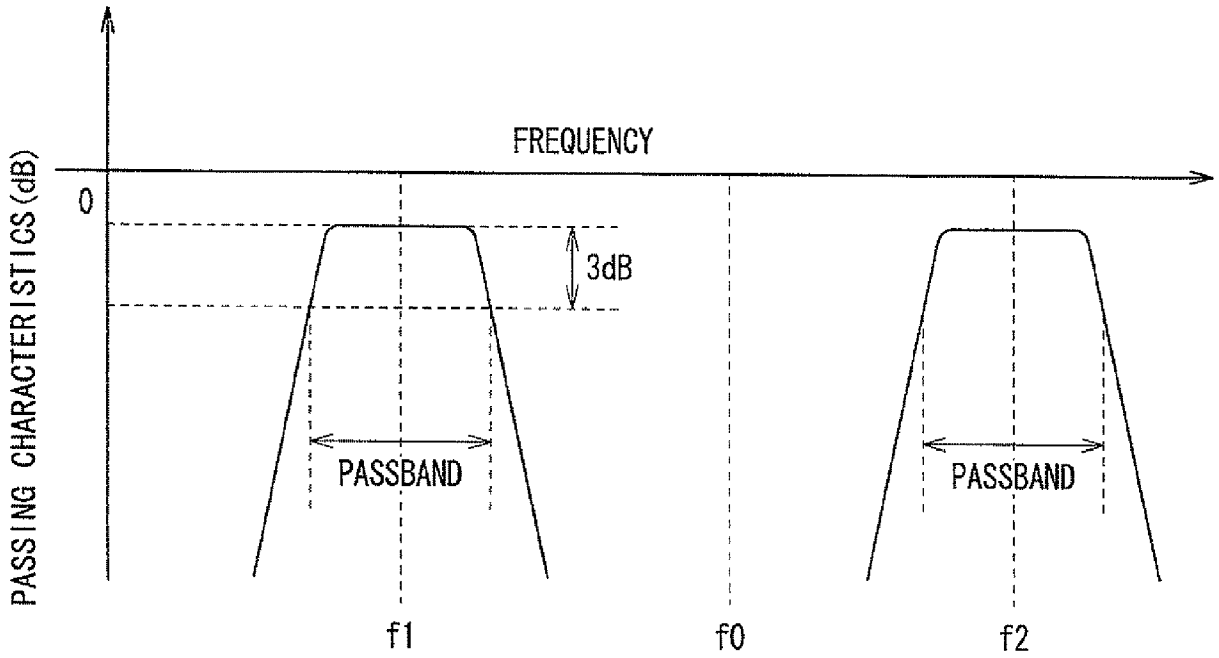
FIG. 6 is a diagram illustrating passbands.

As described above, the signal transmission device of FIG. 1 shows two different frequency responses depending on the states, i.e., in the state that the first and second substrates 10 and 20 are separated away enough from each other so as not to establish electromagnetic coupling therebetween, and in the state that the first and second substrates 10 and 20 are in electromagnetic coupling with each other via an air layer or others. As such, in the state that the first and second substrates 10 and 20 are in electromagnetic coupling with each other, for example, signal transmission is performed at the frequency of a predetermined passband including the first resonance frequency f1 (or the second resonance frequency f2) as shown in FIGS. 5 and 6. On the other hand, in the state that the first and second substrates 10 and 20 are separated away enough from each other so as not to establish electromagnetic coupling therebetween, signal transmission is not performed at the first resonance frequency f1 (or the second resonance frequency f2) because resonance occurs not at the frequency for signal transmission but at the frequency of a different passband including the resonance frequency f0. As such, in the state that the first and second substrates 10 and 20 are separated away enough from each other, even if signals of a band same as that of the first resonance frequency f1 (or of the second resonance frequency f2) are input, the signals are to be reflected, thereby being able to prevent any leakage of signals (electromagnetic waves) from the resonators 11, 12, 21, and 22.

(Specific Exemplary Configuration of Resonators)

Figure 7:
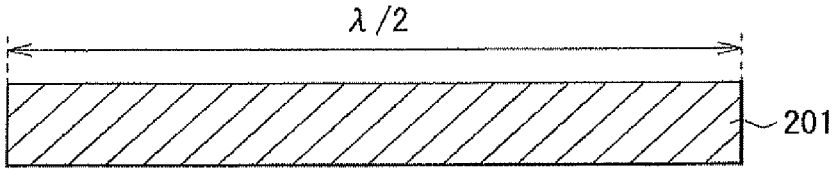
FIG. 7 is a plan view of a resonator being a first specific example.
Figure 8:
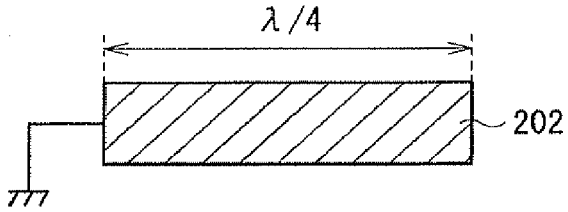
FIG. 8 is a plan view of a resonator being a second specific example.
Figure 9:
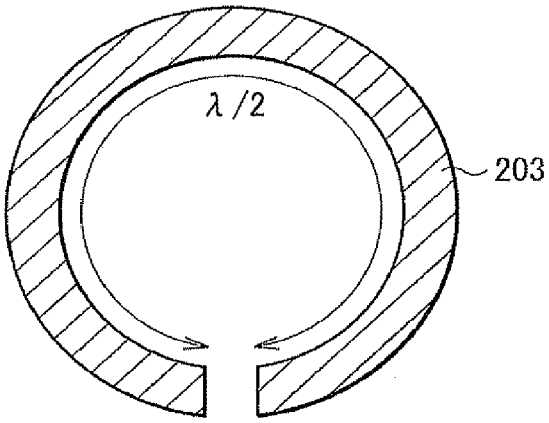
FIG. 9 is a plan view of a resonator being a third specific example.
Figure 10:
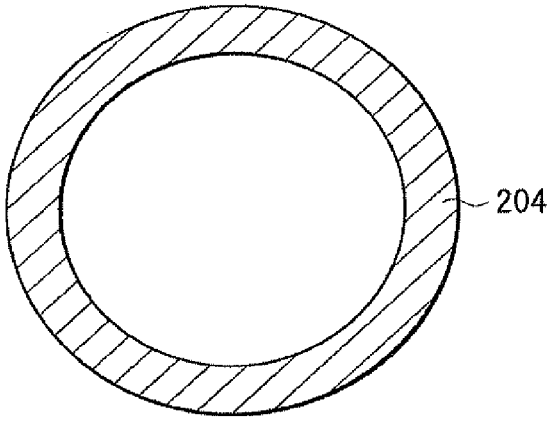
FIG. 10 is a plan view of a resonator being a fourth specific example.
Figure 11:
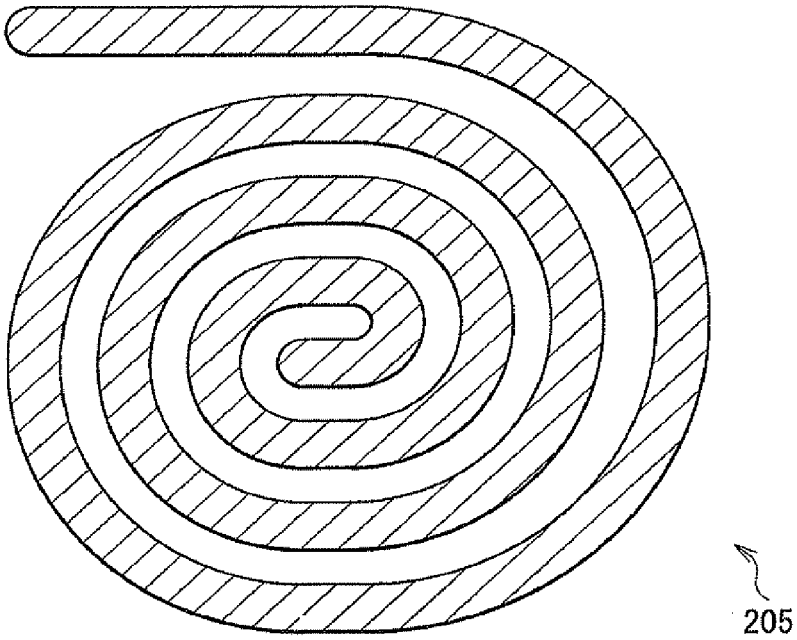
FIG. 11 is a plan view of a resonator being a fifth specific example.
Figure 12:
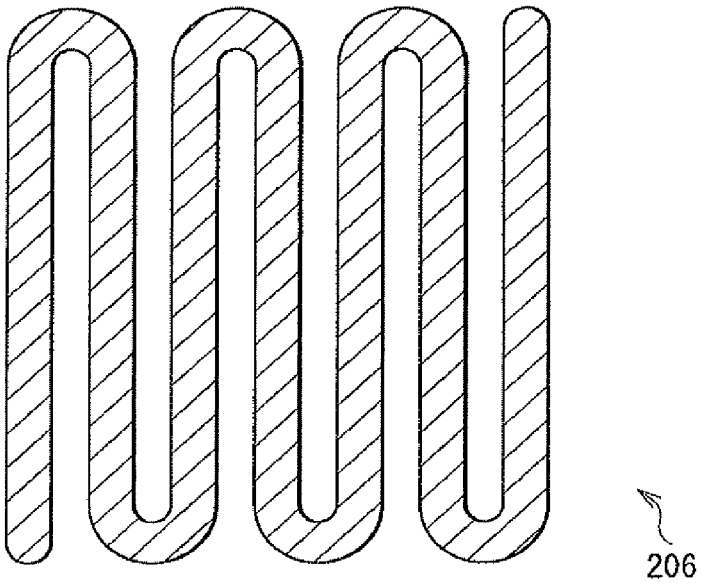
FIG. 12 is a plan view of a resonator being a sixth specific example.
Figure 13:
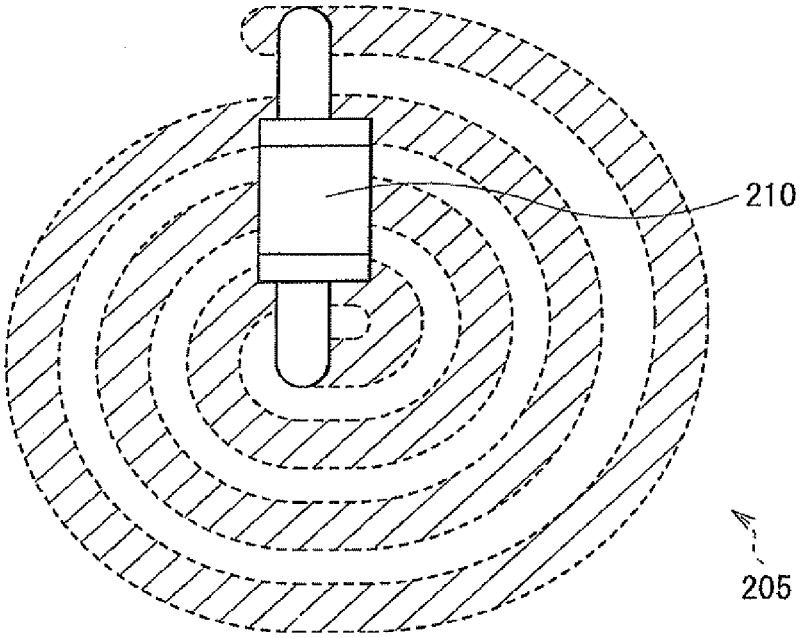
FIG. 13 is a plan view of a resonator being a seventh specific example.
Figure 14:
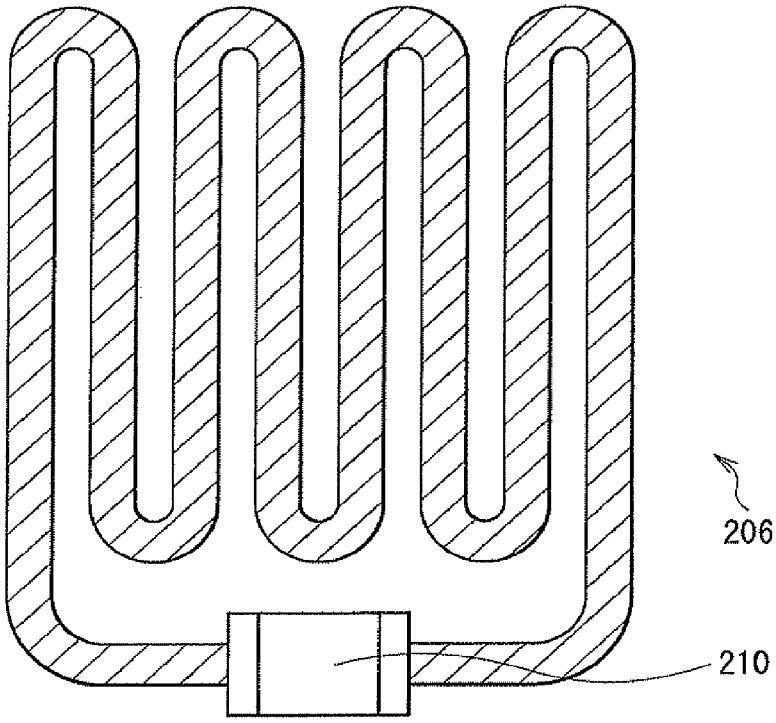
FIG. 14 is a plan view of a resonator being an eighth specific example.

Described next is a specific exemplary configuration of each of the resonators 11, 12, 21, and 22. These resonators 11, 12, 21, and 22 may be configured like line resonators as shown in FIGS. 7 to 12. FIG. 7 shows an exemplary configuration of a line-shaped λ/2 resonator 201, FIG. 8 shows an exemplary configuration of a line-shaped λ/4 resonator 202, FIG. 9 shows an exemplary configuration of a ring-shaped λ/2 resonator 203, and FIG. 10 shows an exemplary configuration of a ring-shaped λ/4 resonator 204. FIG. 11 shows an exemplary configuration of a spiral-shaped resonator 205, and FIG. 12 shows an exemplary configuration of a meander-shaped resonator 206. Alternatively, the resonators 11, 12, 21, and 22 may be each a combination of a discrete component(s) and a line resonator as shown in FIGS. 13 and 14. FIG. 13 shows an exemplary LC resonator configured by the spiral-shaped resonator 205 connected at both end portions with a tip capacitor 210. FIG. 14 shows an exemplary LC resonator configured by the meander-shaped resonator 206 connected at both end portions with the tip capacitor 210.

Figure 15:
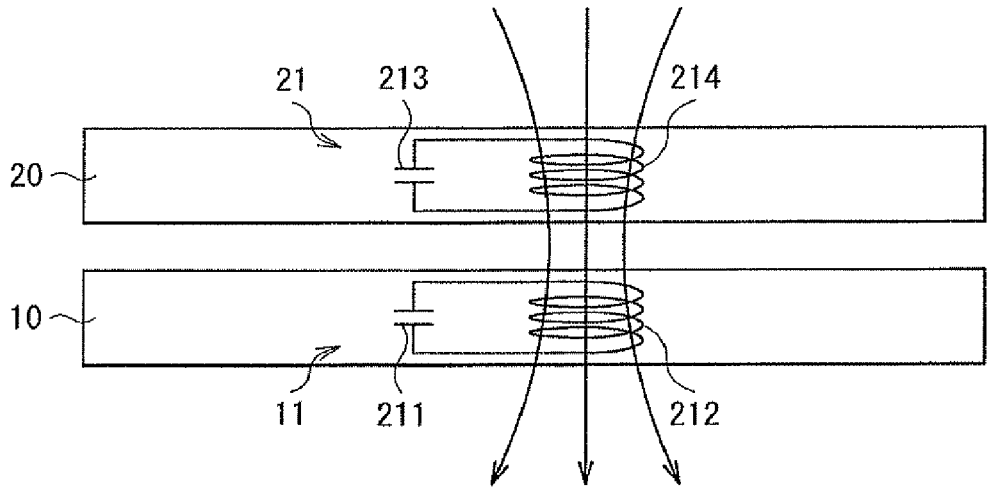
FIG. 15 is a circuit diagram of a resonator being a ninth specific example.
Figure 16:
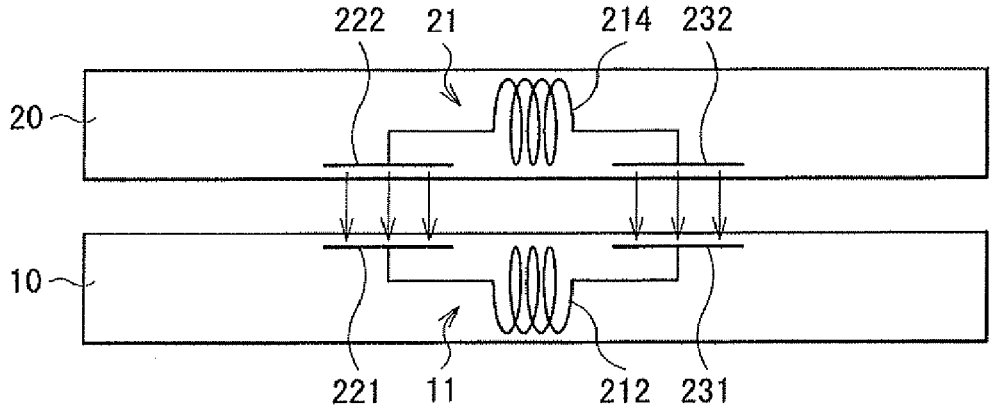
FIG. 16 is a circuit diagram of a resonator being a tenth specific example.

Still alternatively, the resonators 11, 12, 21, and 22 may be lumped-constant resonators as shown in FIGS. 15 and 16. FIG. 15 shows an exemplary configuration of lumped-constant resonators in electromagnetic coupling. In the exemplary configuration of FIG. 15, the first resonator 11 in the first substrate 10 is a first LC resonator configured by a first capacitor 211 and a first coil 212, and the first resonator 21 in the second substrate 20 is a second LC resonator configured by a second capacitor 213 and a second coil 214. In this exemplary configuration, in the state that the first and second substrates 10 and 20 are opposing each other, the first and second coils 212 and 214 are in electromagnetic coupling so that the first resonators 11 and 21 are electromagnetically coupled to each other.

FIG. 16 shows an exemplary configuration of lumped-constant resonators in electric-field coupling. In the exemplary configuration of FIG. 16, the first resonator 11 in the first substrate 10 is a first LC resonator configured to include the first coil 212, and first and second capacitor electrodes 221 and 231. The first capacitor electrode 221 is connected at a first end portion of the first coil 212, and the second capacitor electrode 231 is connected at a second end portion of the first coil 212. The first resonator 21 in the second substrate 20 is a second LC resonator configured to include the second coil 214, and third and fourth capacitor electrodes 222 and 232. The third capacitor electrode 222 is connected at a first end portion of the second coil 214, and the fourth capacitor electrode 232 is connected at a second end portion of the second coil 214. In this exemplary configuration, in the state that the first and second substrates 10 and 20 are opposing each other, the opposing first and third capacitor electrodes 221 and 222 are in electric-field coupling so that the first capacitor is formed. Similarly, the opposing second and fourth capacitor electrodes 231 and 232 are in electric-field coupling so that the second capacitor is formed. As such, in the state that the first and second substrates 10 and 20 are opposing each other, the first resonators 11 and 21 are in electric-field coupling to each other. Herein, in the state that the first and second substrates 10 and 20 are separated away enough from each other, the first and second capacitor electrodes 221 and 231 in the first substrate 10 each form a capacity exemplarily between ground electrodes, e.g., a capacity between ground electrodes formed inside or outside of the substrate or an earth capacity, thereby configuring the first LC resonator resonating at the resonance frequency f0 together with the first coil 212. Similarly, the third and fourth capacitor electrodes 222 and 232 in the second substrate 20 each form a capacity exemplarily between ground electrodes, thereby configuring the second LC resonator resonating at the resonance frequency f0 together with the second coil 214.

(Modification)

Figure 17:
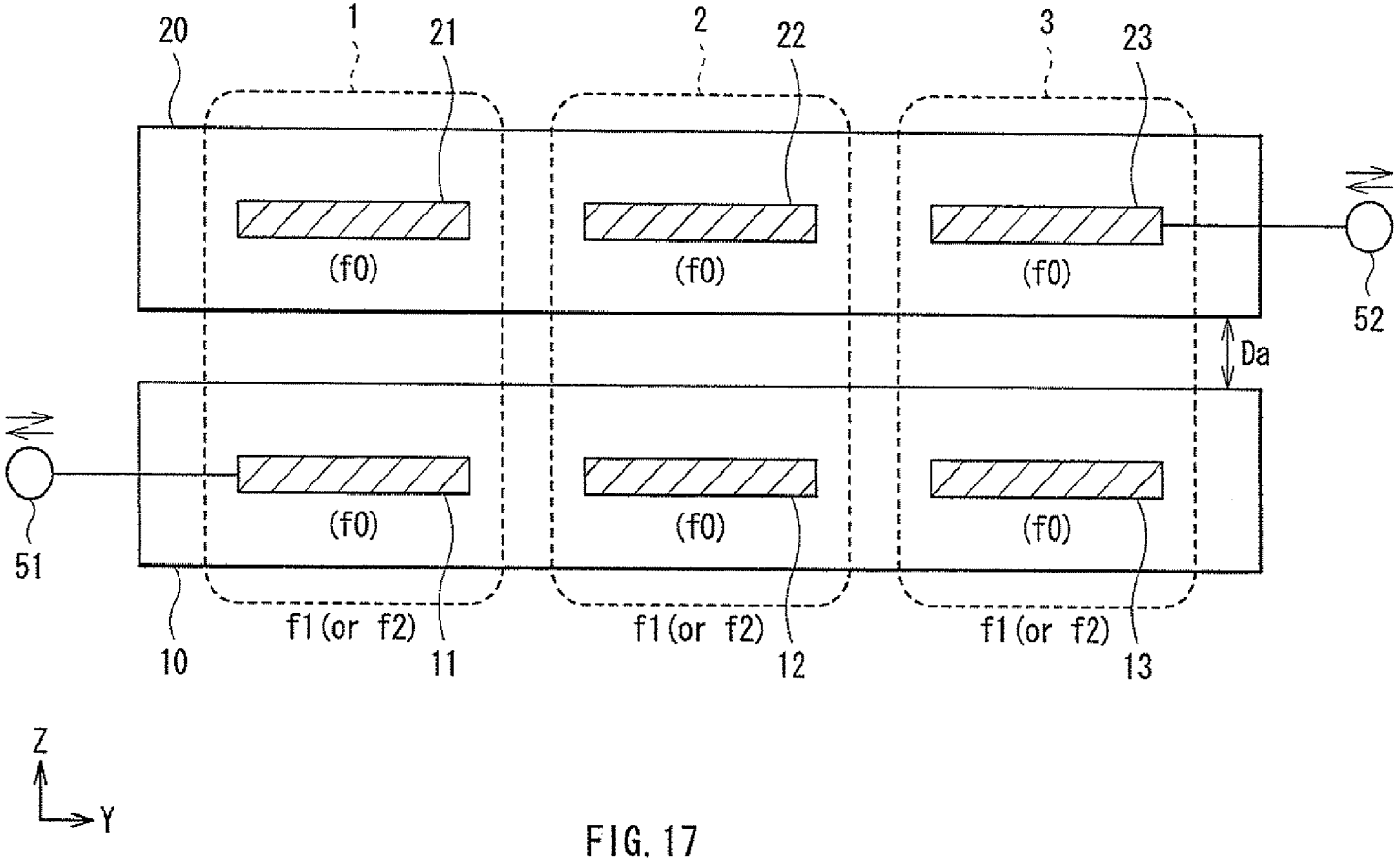
FIG. 17 is a cross-sectional view of a modification of the signal transmission device of FIG. 1 together with a resonance frequency of each substrate component.

In the exemplary configuration of FIG. 1, in the state that the first and second substrates 10 and 20 are opposing each other in the first direction, the two resonators, i.e., the first and second resonance sections 1 and 2, are disposed in parallel to each other. Alternatively, three or more resonance sections may be disposed in parallel to one another. FIG. 17 shows an exemplary configuration in which a third resonance section 3 is additionally disposed in parallel to the first and second resonance sections 1 and 2 in the state that the first and second substrates 10 and 20 are opposing each other in the first direction.

In the modification of FIG. 17, the first substrate 10 is formed additionally with a third resonator 13 in parallel to the first and second resonators 11 and 12 in the second direction (Y-direction in the drawing). Similarly, the second substrate 20 is formed additionally with a third resonator 33 in parallel to the first and second resonators 21 and 22 in the second direction. Similarly to the first resonator 11 or others, the third resonators 13 and 33 may be each a line resonator with a line electrode pattern, e.g., a λ/4 wavelength resonator, a λ/2 wavelength resonator, a 3λ/4 wavelength resonator, or a λ wavelength resonator. The line resonators as such are each of a one-side short-circuited type, a both-end short-circuited type, or a both-end open type, for example.

The third resonance section 3 is formed by, in the state that the first and second substrates 10 and 20 are opposing each other in the first direction, electromagnetically coupling the third resonator 13 in the first substrate 10 and the third resonator 23 in the second substrate 20 opposing each other in the first direction. The third resonance section 3 is so configured as to be electromagnetically coupled to the adjacent second resonance section 2 through resonance at the predetermined resonance frequency, i.e., the first or second resonance frequency f1 or f2 in the hybrid resonance mode. Between the second and third resonance sections 2 and 3, signal transmission is to be performed with a predetermined passband including the predetermined resonance frequency. On the other hand, in the state that the first and second substrates 10 and 20 are separated away from each other so as not to establish electromagnetic coupling therebetween, the resonators 13 and 23 forming the third resonance section 3 are to resonate at a resonance frequency different from the predetermined resonance frequency, i.e., resonance frequency f0.

In this modification, the second input/output terminal 52 is connected directly physically to the third resonator 23 in the second substrate 20, i.e., electrical continuity is directly established therebetween. With this configuration, signal transmission is expected to be performed between the second input/output terminal 52 and the third resonance section 3. Because the first resonance section 1 is electromagnetically coupled to the second resonance section 2, and the second resonance section 2 is electromagnetically coupled to the third resonance section 3, signal transmission is expected to be performed between the first and second input/output terminals 51 and 52. As such, in the state that the first and second substrates 10 and 20 are opposing each other in the first direction, signal transmission is expected to be performed between the two substrates, i.e., the first and second substrates 10 and 20.

Second Embodiment

Described next is a signal transmission device in a second embodiment of the present disclosure. Herein, any component part substantially the same as that of the signal transmission device in the first embodiment described above is provided with the same reference numeral, and is not described again if appropriate.

Figure 18:
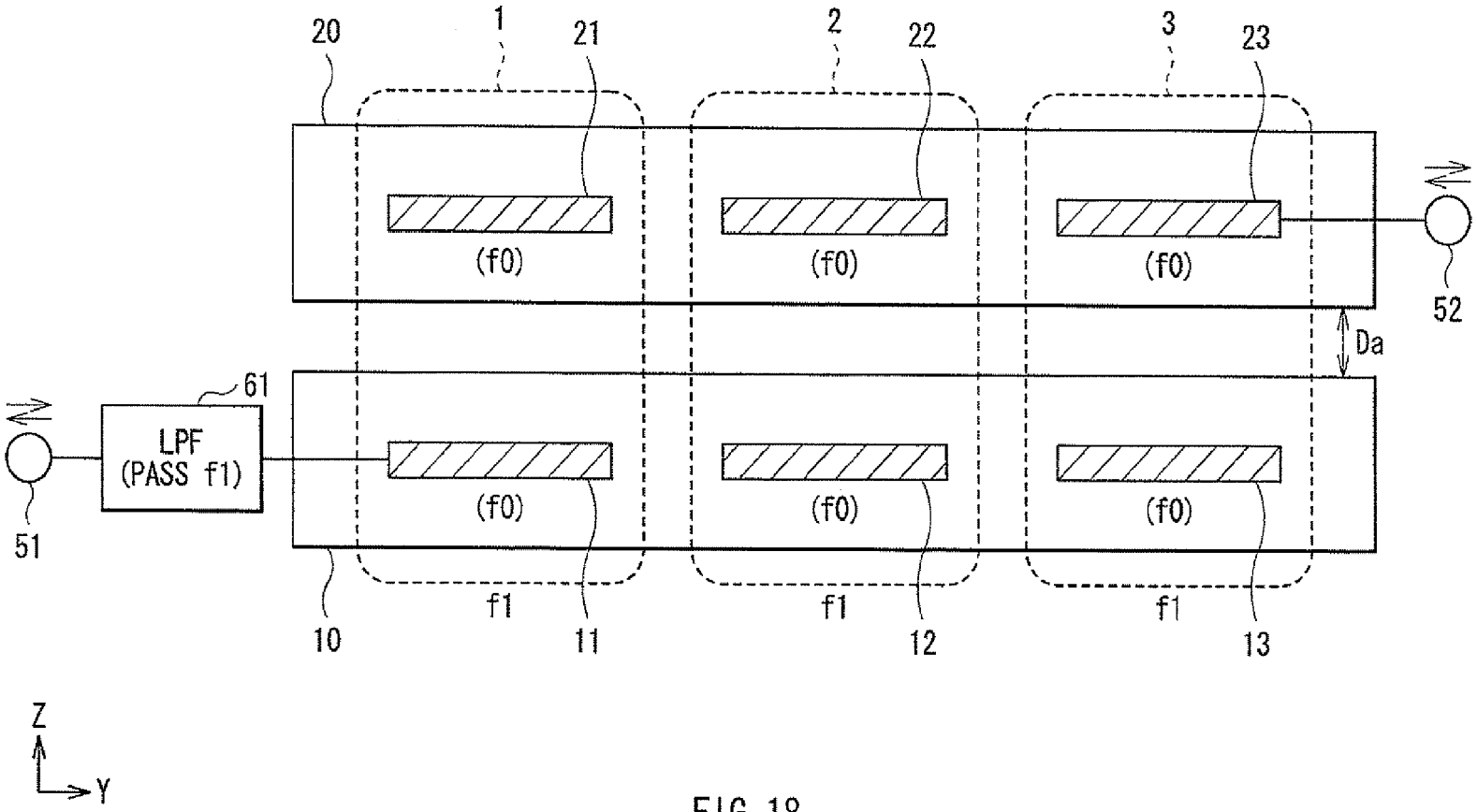
FIG. 18 is a cross-sectional view of a signal transmission device in a second embodiment of the present disclosure, showing a first exemplary configuration thereof together with a resonance frequency of each substrate component.

FIG. 18 shows a first exemplary configuration of the signal transmission device in the second embodiment. Although the signal transmission device in this first exemplary configuration is configured basically the same as the signal transmission device of FIG. 17, there is a difference therefrom that the first input/output terminal 51 is connected with an LPF (Low-Pass Filter) 61. In such a signal transmission device, the first, second, and third resonance sections 1, 2, and 3 are in electromagnetic coupling at a predetermined resonance frequency, i.e., a lower frequency in the hybrid resonance mode (first resonance frequency f1), and the passband for signals is a range including the first resonance frequency f1. The LPF 61 is a filter member that allows passage of signals of a predetermined passband including the predetermined resonance frequency, i.e., first resonance frequency f1, but interrupts the passage of signals of any other resonance frequency not in or out of the range of the predetermined passband, i.e., resonance frequency f0 for each of the resonators not in electromagnetic coupling. In this signal transmission device, in the state that the first and second substrates 10 and 20 are separated away enough from each other so as not to establish electromagnetic coupling therebetween, because the resonators 11, 12, 13, 21, 22, and 23 each resonate at the resonance frequency f0, no signal is to be transmitted at the first resonance frequency f1 being the passband for signals. Moreover, in this state, even if signals of the resonance frequency f0 are input to the first input/output terminal 51 side, for example, the signals of the resonance frequency f0 are to be reflected by the LPF 61. Moreover, the LPF 61 interrupts also the output of signals of the resonance frequency f0 from the first resonator 11 in the first substrate 10 to the first input/output terminal 51 side. Accordingly, any leakage of signals (electromagnetic waves) from the resonators 11, 12, 13, 21, 22, and 23 is favorably prevented with more effect.

Figure 19:
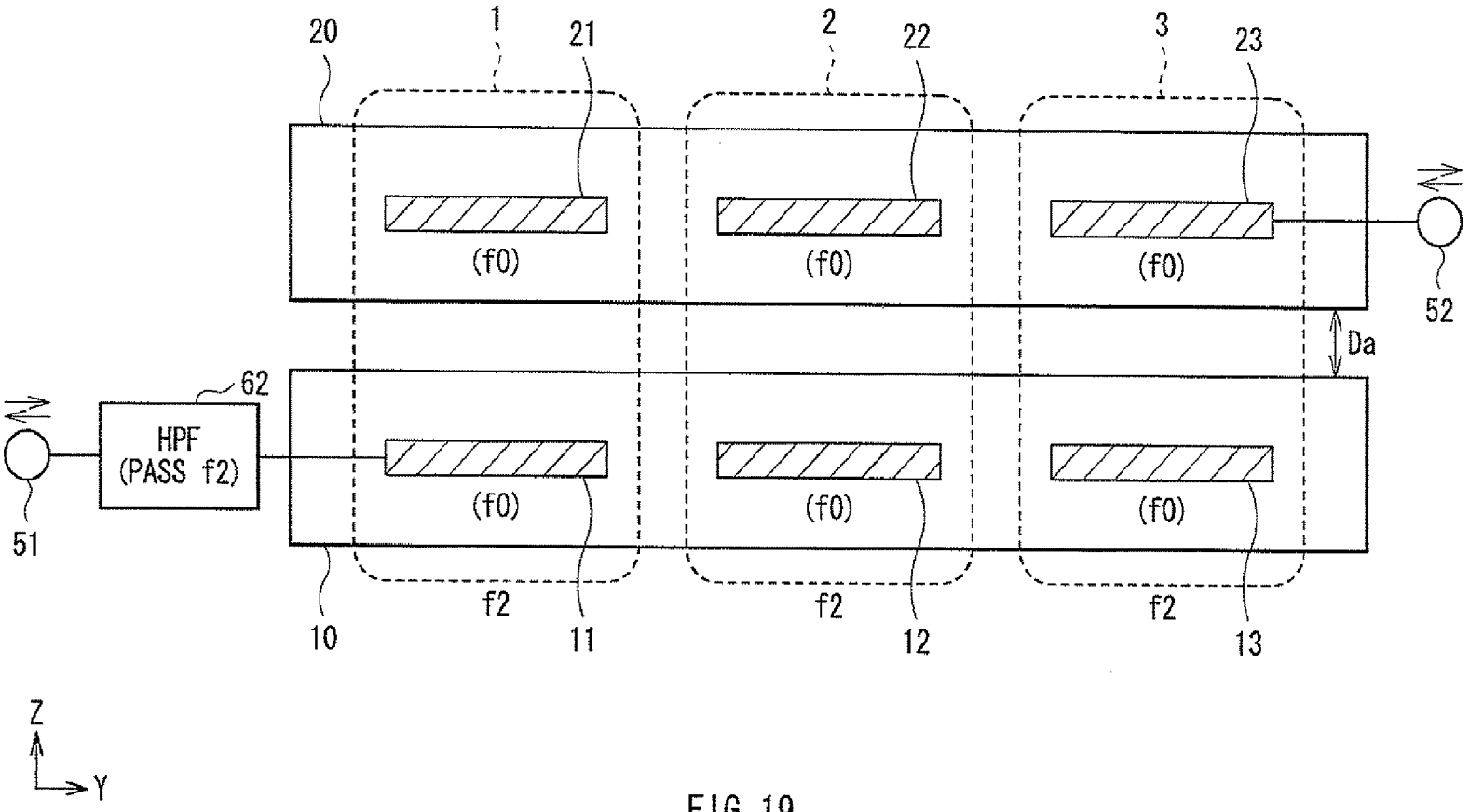
FIG. 19 is a cross-sectional view of the signal transmission device in the second embodiment of the present disclosure, showing a second exemplary configuration thereof together with a resonance frequency of each substrate component.

FIG. 19 shows a second exemplary configuration of the signal transmission device in this embodiment. Although the signal transmission device in this second exemplary configuration is configured basically the same as the signal transmission device of FIG. 17, there is a difference therefrom that the first input/output terminal 51 is connected with an HPF (High-Pass Filter) 62. In such a signal transmission device, the first, second, and third resonance sections 1, 2, and 3 are in electromagnetic coupling at a predetermined resonance frequency, i.e., a higher frequency in the hybrid resonance mode (second resonance frequency f2), and the passband for signals is a range including the second resonance frequency f2. The HPF 62 is a filter member that allows passage of signals of a predetermined passband including the predetermined resonance frequency, i.e., second resonance frequency f2, but interrupts the passage of signals of any other resonance frequency not in the range of the predetermined passband, i.e., resonance frequency f0 for each of the resonators not in electromagnetic coupling. In this signal transmission device, in the state that the first and second substrates 10 and 20 are separated away enough from each other so as not to establish electromagnetic coupling therebetween, because the resonators 11, 12, 13, 21, 22, and 23 each resonate at the resonance frequency f0, no signal is to be transmitted at the second resonance frequency f2 being the passband for signals. Moreover, in this state, even if signals of the resonance frequency f0 are input to the first input/output terminal 51 side, for example, the signals of the resonance frequency f0 are to be reflected by the HPF 62. Moreover, the HPF 62 interrupts also the output of signals of the resonance frequency f0 from the first resonator 11 in the first substrate 10 to the first input/output terminal 51 side. Accordingly, any leakage of signals (electromagnetic waves) from the resonators 11, 12, 13, 21, 22, and 23 is favorably prevented with more effect.

Figure 20:
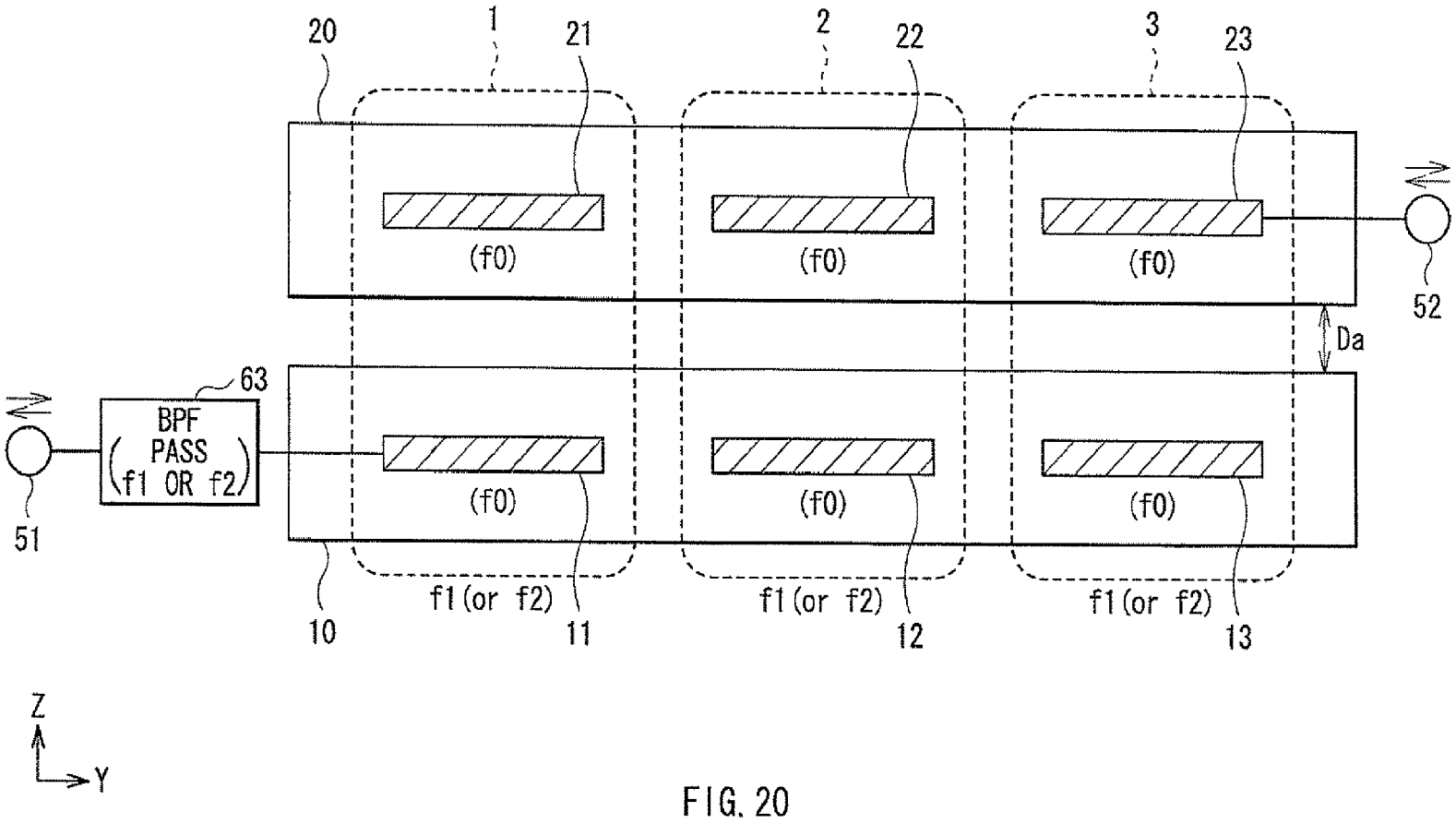
FIG. 20 is a cross-sectional view of the signal transmission device in the second embodiment of the present disclosure, showing a third exemplary configuration thereof together with a resonance frequency of each substrate component.

FIG. 20 shows a third exemplary configuration of the signal transmission device in this embodiment. Although the signal transmission device in this third exemplary configuration is configured basically the same as the signal transmission device of FIG. 17, there is a difference therefrom that the first input/output terminal 51 is connected with a BPF (Band-Pass Filter) 63. In such a signal transmission device, the first, second, and third resonance sections 1, 2, and 3 are in electromagnetic coupling at the predetermined resonance frequency, i.e., the first or second resonance frequency f1 or f2 in the hybrid resonance mode, and the passband for signals is a range including the first or second resonance frequency f1 or f2. The BPF 63 is a filter member that allows passage of signals of a predetermined passband including the predetermined resonance frequency, i.e., the first or second resonance frequency f1 or f2, but interrupts the passage of signals of any other resonance frequency not in the range of the predetermined passband, i.e., the resonance frequency f0 for each of the resonators not in electromagnetic coupling. In this signal transmission device, in the state that the first and second substrates 10 and 20 are separated away enough from each other so as not to establish electromagnetic coupling therebetween, because the resonators 11, 12, 13, 21, 22, and 23 each resonate at the resonance frequency f0, no signal is to be transmitted at the first or second resonance frequency f1 or f2 being the passband for signals. Moreover, in this state, even if signals of the resonance frequency f0 are input to the first input/output terminal 51 side, for example, the signals of the resonance frequency f0 are to be reflected by the BPF 63. Moreover, the BPF 63 interrupts also the output of signals of the resonance frequency f0 from the first resonator 11 in the first substrate 10 to the first input/output terminal 51 side. Accordingly, any leakage of signals (electromagnetic waves) from the resonators 11, 12, 13, 21, 22, and 23 is favorably prevented with more effect.

Figure 21:
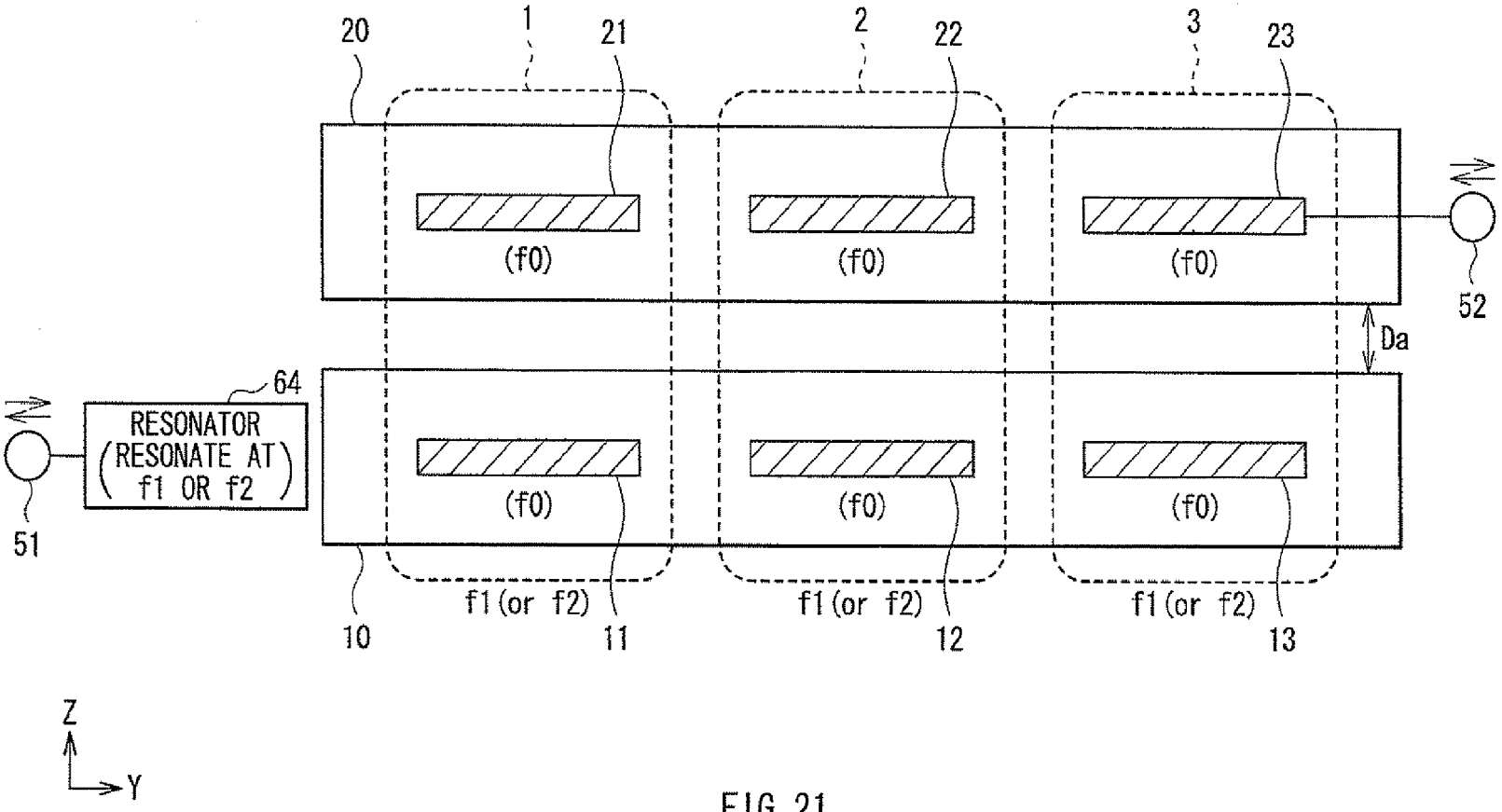
FIG. 21 is a cross-sectional view of the signal transmission device in the second embodiment of the present disclosure, showing a fourth exemplary configuration thereof together with a resonance frequency of each substrate component.

FIG. 21 shows a fourth exemplary configuration of the signal transmission device in this embodiment. Although the signal transmission device in this fourth exemplary configuration is configured basically the same as the signal transmission device of FIG. 17, there is a difference therefrom that the first input/output terminal 51 is connected with a resonator 64. The resonator 64 is not connected directly physically to the first resonator 11 in the first substrate 10 but is disposed with a spacing from the first resonator 11.

In the signal transmission device of FIG. 21, the first, second, and third resonance sections 1, 2, and 3 are in electromagnetic coupling at the predetermined resonance frequency, i.e., the first or second resonance frequency f1 or f2 in the hybrid resonance mode, and the passband for signals is a range including the first or second resonance frequency f1 or f2. The resonator 64 is a filter member that allows passage of signals of a predetermined passband including the predetermined resonance frequency, i.e., the first or second resonance frequency f1 or f2, but interrupts the passage of signals of any other resonance frequency not in the range of the predetermined passband, i.e., the resonance frequency f0 for each of the resonators not in electromagnetic coupling. The resonance frequency of the resonator 64 is assumed to be in the passband for signals, i.e., the first or second resonance frequency f1 or f2. Accordingly, in the state that the first resonator 11 in the first substrate 10 and the first resonator 21 in the second substrate 20 are in electromagnetic coupling at the first or second resonance frequency f1 or f2, the resonator 64 is electromagnetically coupled to the first resonator 11 (first resonance section 1). In this state, when signals of the first or second resonance frequency f1 or f2 are provided by the first input/output terminal 51, the signals are transmitted to the first resonance section 1 via the resonator 64.

In this signal transmission device of FIG. 21, in the state that the first and second substrates 10 and 20 are separated away enough from each other so as not to establish electromagnetic coupling therebetween, because the resonators 11, 12, 13, 21, 22, and 23 each resonate at the resonance frequency f0, no signal is to be transmitted at the first or second resonance frequency f1 or f2 being the passband for signals. Moreover, in this state, the resonator 64 is not electromagnetically coupled to the first resonator 11 because the state is different from the resonance frequency of the resonator 64 connected to the first input/output terminal 51. As such, in this state, even if signals of the resonance frequency f0 are input to the first input/output terminal 51 side, for example, the signals of the resonance frequency f0 are to be reflected by the resonator 64. Accordingly, any leakage of signals (electromagnetic waves) from the resonators 11, 12, 13, 21, 22, and 23 is favorably prevented with more effect.

Note that FIGS. 18 to 21 show the examples of connecting the LPF61, the resonator 64, and others to the first input/output terminal 51 side. Alternatively, the LPF 61, the resonator 64, and others may be connected to the second input/output terminal 52 side. Still alternatively, the LPF 61, the resonator 64, and others may be connected to both the sides of the first and second input/output terminals 51 and 52.

Further, FIGS. 18 to 21 show the examples in which the filter member is the LPF (Low-Pass Filter), the HPF (High-Pass Filter), the BPF (Band-Pass Filter), or the resonator. Alternatively, the filter member may be a BEF (Band-Elimination Filter) for interrupting signals of the resonance frequency f0 for each of the resonators not in electromagnetic coupling. The filter member serves the purpose as long as it allows passage of signals of a predetermined passband including a predetermined resonance frequency, and interrupts the passage of signals of any other resonance frequency not in the range of a predetermine passband, i.e., the resonance frequency f0 for each of the resonators not in electromagnetic coupling.

Still further, FIGS. 18 to 21 show the examples in which the filter member is connected outside of the substrate. Alternatively, the filter member may be formed inside of the substrate.

Third Embodiment

Described next is a signal transmission device in a third embodiment of the present disclosure. Herein, any component part substantially the same as that of the signal transmission device in the first or second embodiment described above is provided with the same reference numeral, and is not described again if appropriate.

Figure 22:
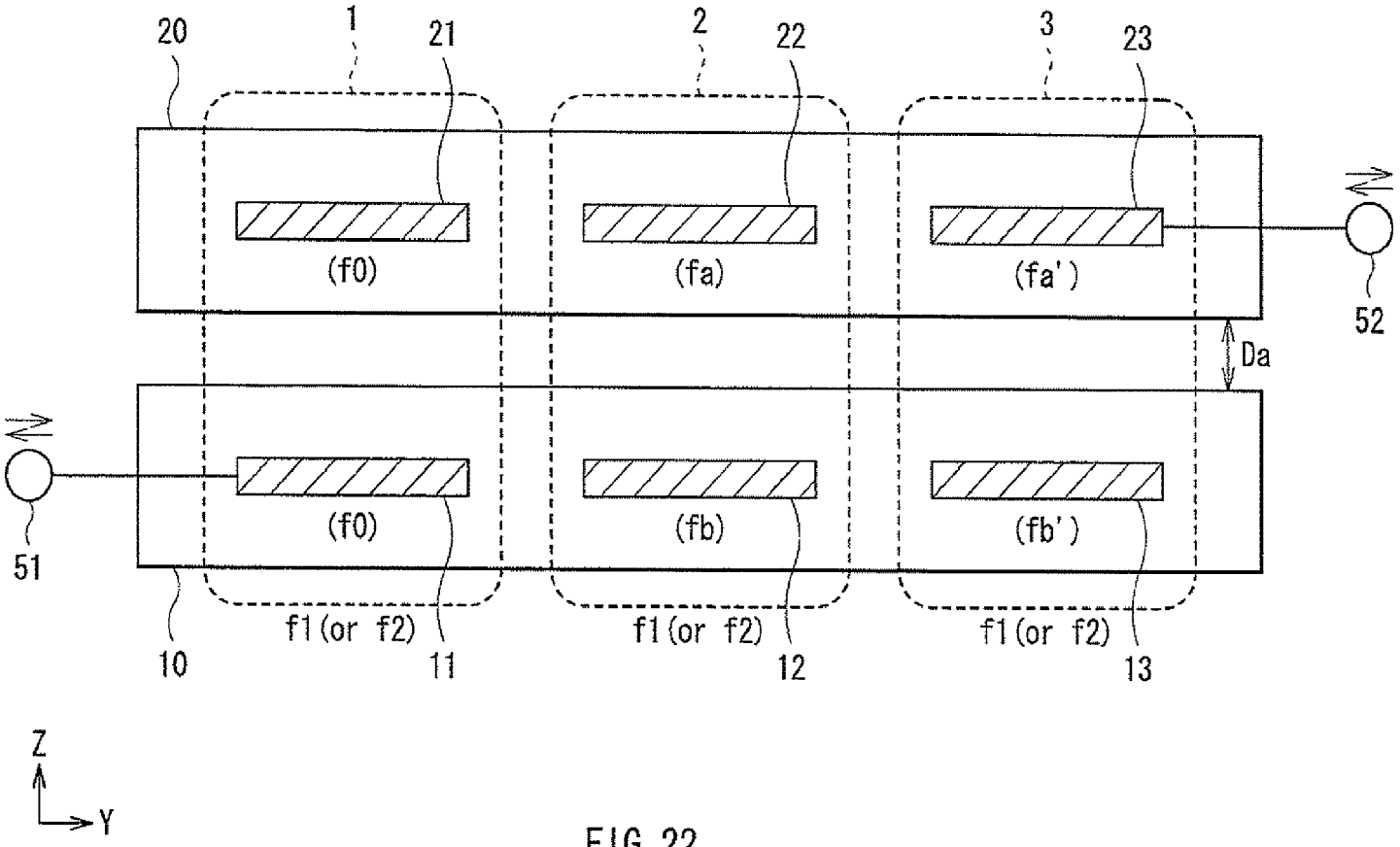
FIG. 22 is a cross-sectional view of a signal transmission device in a third embodiment of the present disclosure, showing an exemplary configuration thereof together with a resonance frequency of each substrate component.

FIG. 22 shows an exemplary configuration of the signal transmission device in the third embodiment. Although the signal transmission device in this exemplary configuration is configured basically the same as the signal transmission device of FIG. 17, there is a difference therefrom that the resonance frequency varies among the resonators 11, 12, 13, 21, 22, and 23 when no electromagnetic coupling is established. That is, in the signal transmission device of FIG. 17, the resonators 11, 12, 13, 21, 22, and 23 respectively configuring the first, second, and third resonance sections 1, 2, and 3 share the same resonance frequency when no electromagnetic coupling is established, i.e., resonance frequency f0, but in the signal transmission device of FIG. 22, the resonance frequency varies.

To be specific, the first resonator 11 in the first substrate 10 is supposed to resonate at the resonance frequency f0, the second resonator 12 therein is at the resonance frequency fb, and the third resonator 13 therein is at the resonance frequency fb' when no electromagnetic coupling is established. Moreover, the first resonator 21 in the second substrate 20 is supposed to resonate at the resonance frequency f0, the second resonator 22 therein is at the resonance frequency fa, and the third resonator 13 therein is at the resonance frequency fa' when no electromagnetic coupling is established. That is, in the same substrate, any resonators adjacent to each other are supposed to resonate at each different resonance frequency, i.e., $f0 \neq fb \neq fb'$, $f0 \neq fa \neq fa'$. Moreover, in each of the second and third resonance sections 2 and 3, the opposing resonators are assumed as resonating at each different resonance frequency when no electromagnetic coupling is established, i.e., $fb \neq fa$, $fb' \neq fa'$.

Herein, in each of the second and third resonance sections 2 and 3, the opposing resonators are assumed as resonating at each different resonance frequency when no electromagnetic coupling is established, but when electromagnetic coupling is established in the hybrid resonance mode with the first and second substrates 10 and 20 opposing each other, the resonance frequency remains, as a whole, the same as the predetermined resonance frequency f1 (or the second resonance frequency f2). That is, also in this embodiment, through electromagnetic coupling in the mixed resonance frequency between the second resonator 12 in the first substrate 10 and the second resonator 22 in the second substrate 20, the resonators resonate, as a whole, at the predetermined first resonance frequency (or the second resonance frequency). Similarly, through electromagnetic coupling in the hybrid resonance mode between the third resonator 13 in the first substrate 10 and the third resonator 23 in the second substrate 20, the resonators resonate, as a whole, at the predetermined first resonance frequency (or the second resonance frequency).

According to this embodiment, as for the resonators 11, 12, and 13 in the first substrate 10, the adjacent resonators resonate at different resonance frequencies. Accordingly, in the state that the first and second substrates 10 and 20 are separated away enough from each other so as not to establish electromagnetic coupling therebetween, in the first substrate, the first and second resonators 11 and 12 are not in electromagnetic coupling, and the second and third resonators 12 and 13 are also not in electromagnetic coupling. Moreover, the degree of electromagnetic coupling between the first and third resonators 11 and 13 is very small or negligible. Similarly, as for the resonators 21, 22, and 23 in the second substrate 20, the adjacent resonators resonate at different resonance frequencies. Accordingly, in the state that the first and second substrates 10 and 20 are separated away enough from each other so as not to establish electromagnetic coupling therebetween, in the second substrate 20, the first and second resonators 21 and 22 are not in electromagnetic coupling, and the second and third resonators 22 and 23 are also not in electromagnetic coupling. Moreover, the degree of electromagnetic coupling between the first and third resonators 21 and 23 is very small or negligible. The resonators 21, 22, and 23 are not in electromagnetic coupling. Accordingly, any leakage of signals (electromagnetic waves) from the resonators 11, 12, 13, 21, 22, and 23 is to be prevented with more effect.

Note that, when the resonators in the same substrate are supposed to resonate at each different resonance frequency, i.e., f0≠fb≠fb' and f0≠fb', and f0≠fa≠fa' and f0≠fa', in the state that the first and second substrates 10 and 20 are separated away enough from each other so as not to establish electromagnetic coupling therebetween, electromagnetic coupling is not established among the resonators 11, 12, and 13 in the first substrate 10, and similarly, electromagnetic coupling is not established among the resonators 21, 22, and 23 in the second substrate 20. This is preferable because any leakage of signals (electromagnetic waves) from the resonators 11, 12, 13, 21, 22, and 23 is to be prevented thereby with more effect.

Fourth Embodiment

Described next is a signal transmission device in a fourth embodiment of the present disclosure. Herein, any component part substantially the same as that of the signal transmission device in the first to third embodiments described above is provided with the same reference numeral, and is not described again if appropriate.

Figure 23:
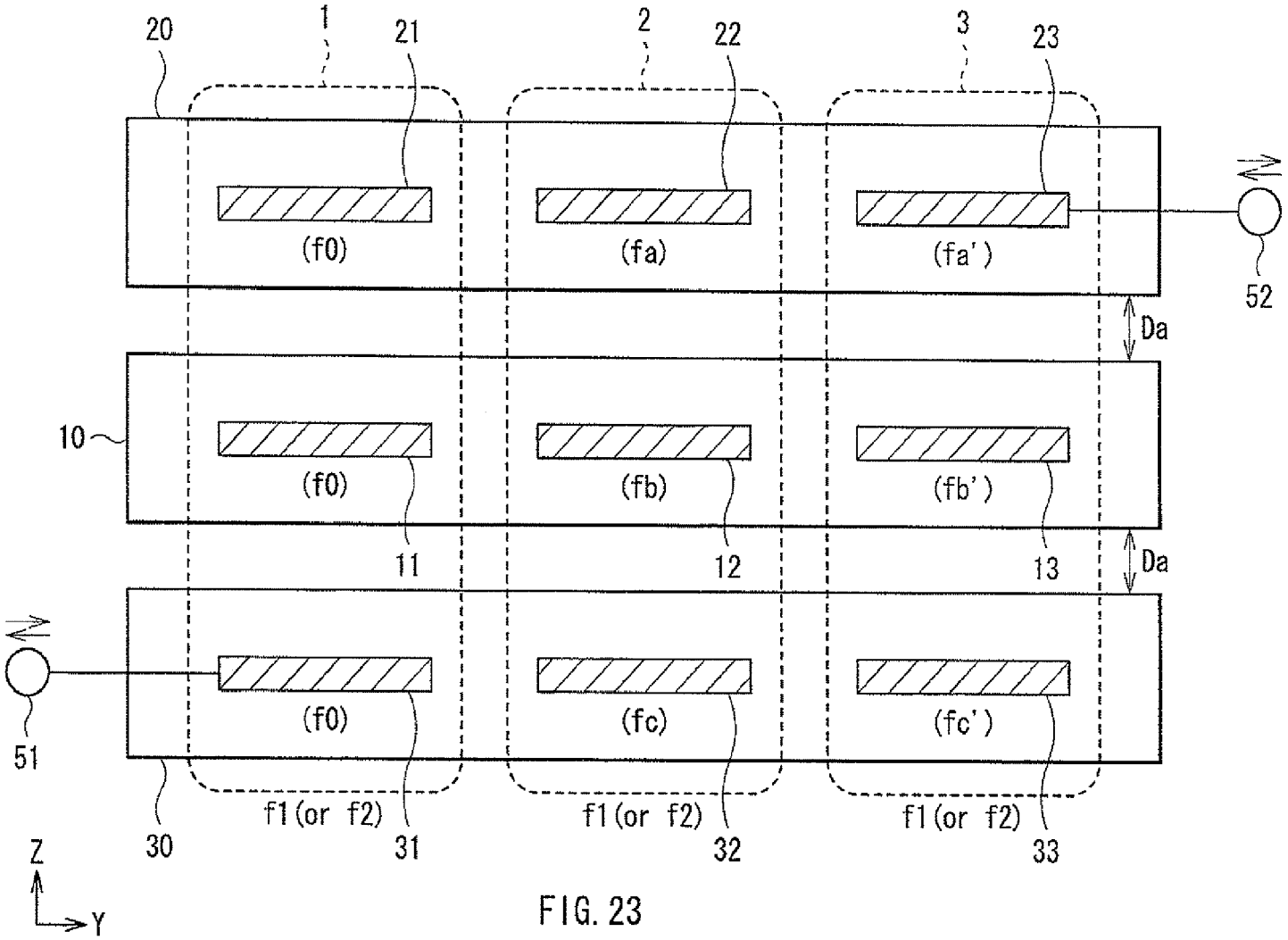
FIG. 23 is a cross-sectional view of a signal transmission device in a fourth embodiment of the present disclosure, showing an exemplary configuration thereof together with a resonance frequency of each substrate component.

In the first to third embodiments described above, exemplified is the configuration of the signal transmission device in which the two substrates 10 and 20 are disposed to oppose each other. Alternatively, three or more substrates may be disposed to oppose one another to configure a signal transmission device. FIG. 23 shows an example of such a configuration, i.e., a third substrate 30 is additionally provided to the signal transmission device of FIG. 22.

The third substrate 30 is formed with first, second, and third resonators 31, 32, and 33 in parallel to each other in the second direction, i.e., Y direction in the drawing. The first input/output terminal 51 is connected directly physically to the first resonator 31 in the third substrate 30, i.e., electrical continuity is directly established therebetween. In the third substrate 30 as such, the first resonator 31 is supposed to resonate at the resonance frequency f0, the second resonator 32 is at the resonance frequency fc, and the third resonator 33 is at the resonance frequency fc' when no electromagnetic coupling is established, i.e., f0≠fc≠fc'.

In this signal transmission device, in the state that the first, second, and third substrates 10, 20, and 30 are opposing each other in the first direction, electromagnetic coupling is established between the resonators opposing each other in the first direction, i.e., the first resonator 11 in the first substrate 10 and the first resonator 21 in the second substrate 20, and the first resonator 11 in the first substrate 10 and the first resonator 31 in the third substrate 30, thereby forming the first resonance section 1. Also in the state that the first, second, and third substrates 10, 20, and 30 are opposing each other in the first direction, electromagnetic coupling is established between the resonators opposing each other in the first direction, i.e., the second resonator 12 in the first substrate 10 and the second resonator 22 in the second substrate 20, and the second resonator 12 in the first substrate 10 and the second resonator 32 in the third substrate 30, thereby forming the second resonance section 2. Also in the state that the first, second, and third substrates 10, 20, and 30 are opposing each other in the first direction, electromagnetic coupling is established between the resonators opposing each other in the first direction, i.e., the third resonator 13 in the first substrate 10 and the third resonator 23 in the second substrate 20, and the third resonator 13 in the first substrate 10 and the third resonator 33 in the third substrate 30, thereby forming the third resonance section 3. As such, in the state that the first, second, and third substrates 10, 20, and 30 are opposing each other in the first direction, the first, second, and third resonance sections 1, 2, and 3 are disposed in parallel to each other in the second direction.

Fifth Embodiment

Described next is a signal transmission device in a fifth embodiment of the present disclosure. Herein, any component part substantially the same as that of the signal transmission device in the first to fourth embodiments described above is provided with the same reference numeral, and is not described again if appropriate.

Figure 24:
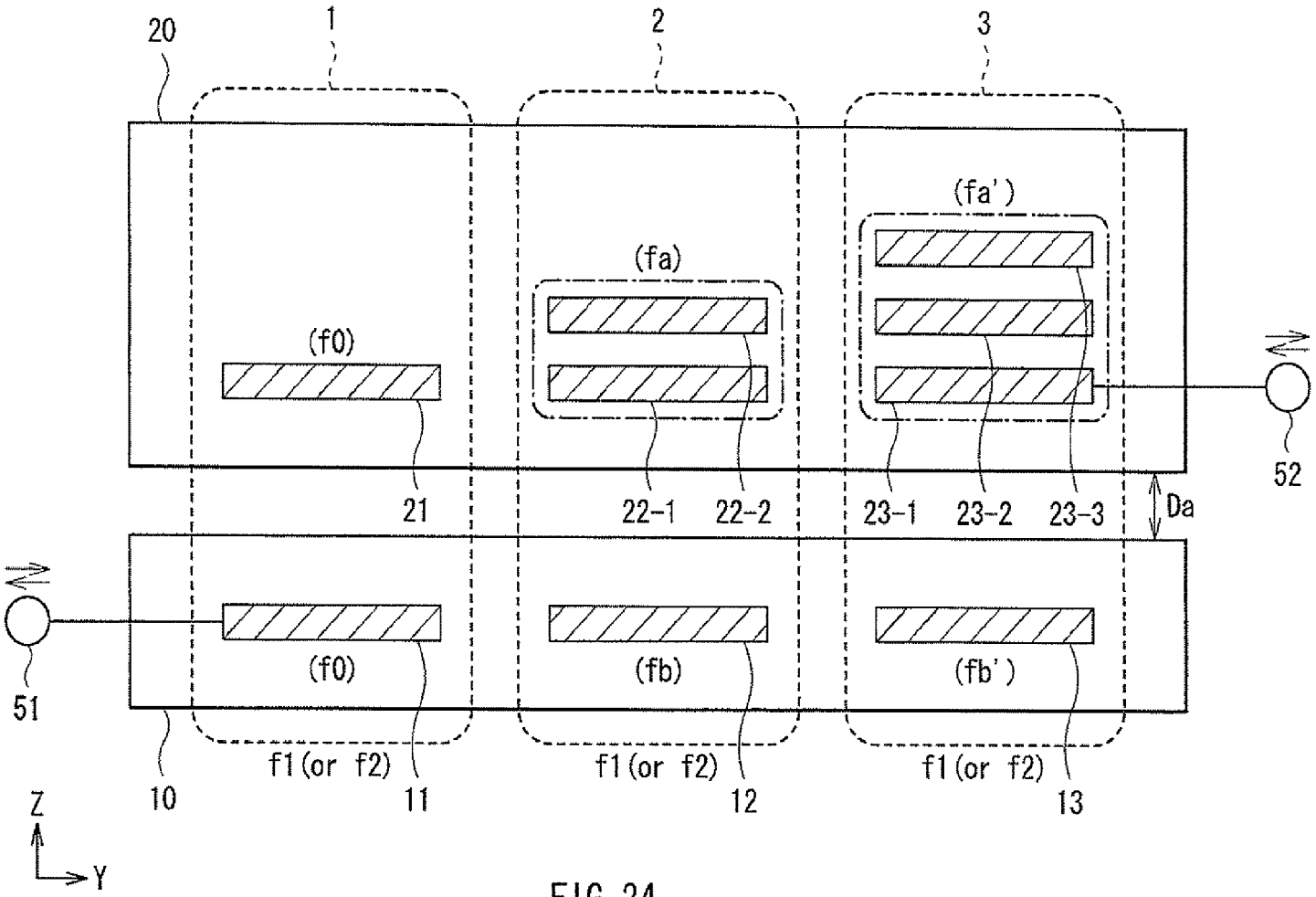
FIG. 24 is a cross-sectional view of a signal transmission device in a fifth embodiment of the present disclosure, showing an exemplary configuration thereof together with a resonance frequency of each substrate component.

In the embodiments described above, exemplified is the configuration in which the substrate and the resonator has a one-to-one relationship in the first direction, i.e., Z direction. Alternatively, a plurality of resonators may be formed in layers in the first direction in one substrate. FIG. 24 shows an example of such a configuration, i.e., resonators in the second resonator 20 are configured differently in the signal transmission device of FIG. 22.

In the configuration example of FIG. 24, the second resonator 22 in the second substrate 20 of FIG. 22 is configured by two second resonators 22-1 and 22-2, which are disposed one on the other in the first direction. The second resonator 23 is configured by three third resonators 23-1, 23-2, and 23-3, which are disposed one on the other in the first direction. In the state that the first and second substrates 10 and 20 are disposed away enough from each other so as not to establish electromagnetic coupling therebetween, the two second resonators 22-1 and 22-2 both resonate at a resonance frequency fa similarly to the second resonator 22 of FIG. 22. The three third resonators 23-1, 23-2, and 23-3 all resonate at the resonance frequency fa' similarly to the third resonator 23 of FIG. 22. The signal transmission device of FIG. 24 operates, for signal transmission, substantially similarly to the signal transmission device of FIG. 22.

Sixth Embodiment

Described next is a signal transmission device in a sixth embodiment of the present disclosure. Herein, any component part substantially the same as that of the signal transmission device in the first to fifth embodiments described above is provided with the same reference numeral, and is not described again if appropriate.

Figure 25:
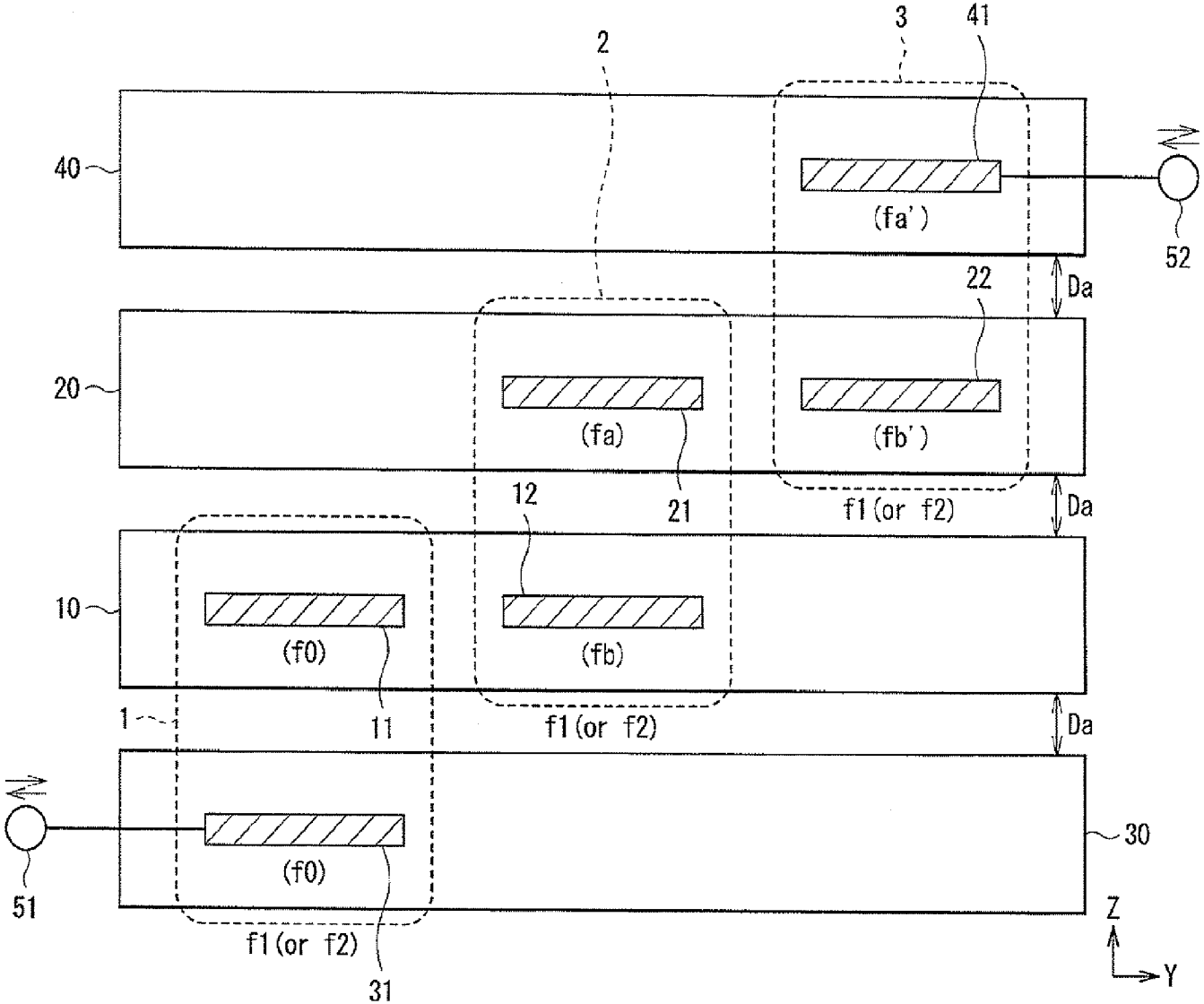
FIG. 25 is a cross-sectional view of a signal transmission device in a sixth embodiment of the present disclosure, showing an exemplary configuration thereof together with a resonance frequency of each substrate component.

In the embodiments described above, exemplified is the configuration in which the resonators configuring the resonance sections are formed to a plurality of substrates in the same combination. Alternatively, the resonators configuring the resonance sections may be formed to the substrates in the partially different combination. FIG. 25 shows an example of such a configuration, i.e., a fourth substrate 40 is additionally provided to the signal transmission device of FIG. 23, and a combination of substrates configuring a resonance section varies on the resonance section basis.

In the exemplary configuration of FIG. 25, the first substrate 10 is formed therein with the first and second resonators 11 and 12. The second substrate 20 is formed therein with the first and second resonators 21 and 22. The third substrate 30 is formed therein only with the first resonator 31. The fourth substrate 40 is formed therein only with a first resonator 41. The second input/output terminal 52 is connected directly physically to the first resonator 41 in the fourth substrate 40, i.e., electrical continuity is directly established therebetween.

In the exemplary configuration of FIG. 25, in the state that the substrates are opposing each other in the first direction, electromagnetic coupling is established between the resonators opposing each other in the first direction, i.e., the first resonator 11 in the first substrate 10 and the first resonator 31 in the third substrate 30, thereby forming the first resonance section 1. Also in the state that the substrates are opposing each other in the first direction, electromagnetic coupling is established between the resonators opposing each other in the first direction, i.e., the second resonator 12 in the first substrate 10 and the first resonator 21 in the second substrate 20, thereby forming the second resonance section 2. Also in the state that the substrates are opposing each other in the first direction, electromagnetic coupling is established between the resonators opposing in the first direction, i.e., the second resonator 22 in the second substrate 20 and the first resonator 41 in the fourth substrate 40, thereby forming the third resonance section 3. As such, in the state that the substrates are opposing each other in the first direction, the first, second, and third resonance sections 1, 2, and 3 are arranged in the second direction, and in parallel to each other in the diagonal direction.

With such a configuration that a plurality of resonance sections are disposed in the second direction, and in parallel to each other in the diagonal direction, the number of the resonators for placement to each substrate is possibly reduced. Further, when the substrates are adjusted in size to correspond to the number of the resonators, the resulting signal transmission device is favorably reduced in size. Still further, because any resonator for electromagnetic coupling with the first resonator 31 in the third substrate 30 connected directly physically to the first input/output terminal 51 (electrical continuity is directly established therebetween) is not disposed in parallel to the third substrate 30, in the state that the third substrate 30 is disposed away enough from other substrates so as not to establish electromagnetic coupling thereto, any leakage of signals (electromagnetic waves) from the resonator 31 is favorably prevented with effect. Similarly, because any resonator for electromagnetic coupling with the first resonator 41 in the fourth substrate 40 connected directly physically to the second input/output terminal 52 (electrical continuity is directly established therebetween) is not disposed in parallel to the fourth substrate 40, in the state that the fourth substrate 40 is disposed away enough from other substrates so as not to establish electromagnetic coupling thereto, any leakage of signals (electromagnetic waves) from the resonator 41 is favorably prevented with more effect.

Seventh Embodiment

Described next is a signal transmission device in a seventh embodiment of the present disclosure. Herein, any component part substantially the same as that of the signal transmission device in the first to sixth embodiments described above is provided with the same reference numeral, and is not described again if appropriate.

Figure 26:
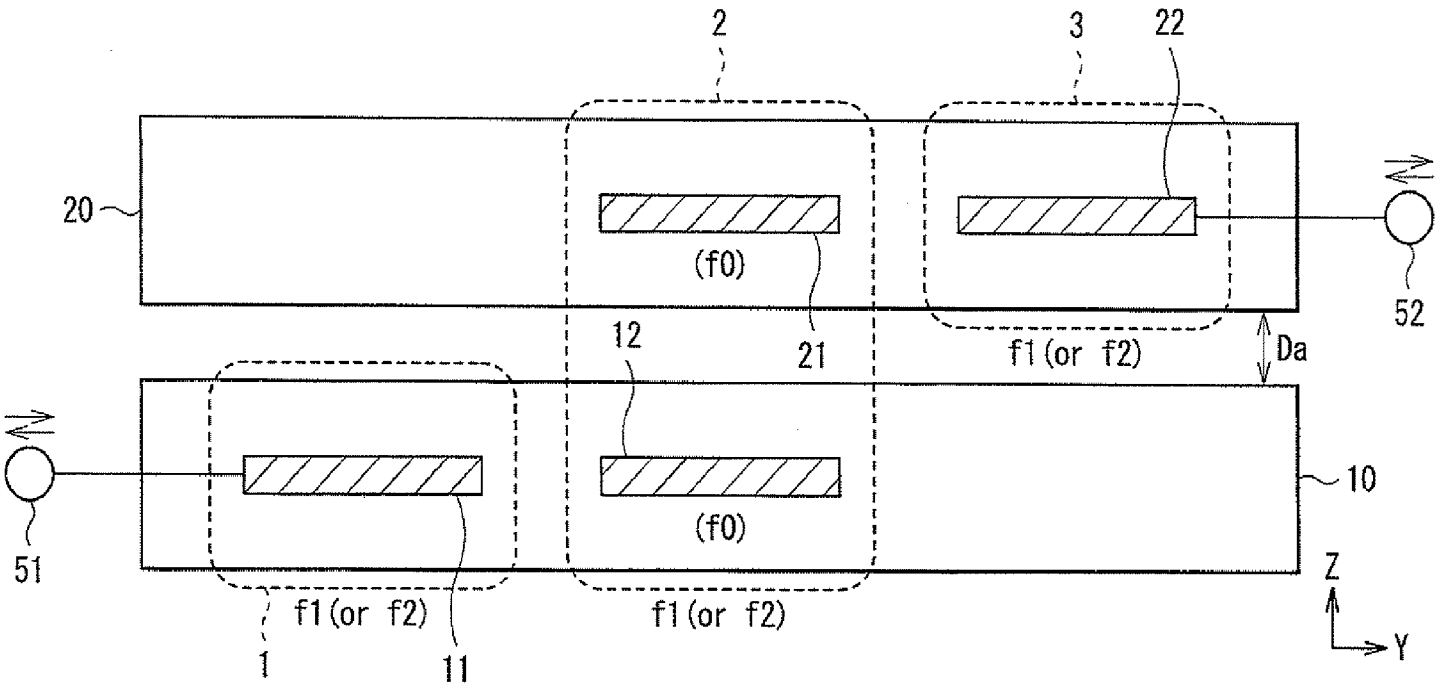
FIG. 26 is a cross-sectional view of a signal transmission device in a seventh embodiment of the present disclosure, showing an exemplary configuration thereof together with a resonance frequency of each substrate component.

In the embodiments described above, exemplified is the configuration in which, in the state that two or more substrates are opposing each other, two or more resonance sections are each configured by a coupled resonator including two or more resonators coupled in the hybrid resonance mode. Alternatively, only one resonance section may configure a coupled resonator in the hybrid resonance mode. FIG. 26 shows an example of such a configuration, i.e., only the second resonance section 2 is configured by a coupled resonator in the hybrid resonance mode in the signal transmission device of FIG. 17.

In the exemplary configuration of FIG. 26, the first substrate 10 is formed therein with the first and second resonators 11 and 12. The second substrate 20 is formed therein with the first and second resonators 21 and 22. The second input/output terminal 52 is connected directly physically to the second resonator 22 in the second substrate 20, i.e., electrical continuity is directly established therebetween.

In the exemplary configuration of FIG. 26, in the state that the first and second substrates 10 and 20 are opposing each other in the first direction, electromagnetic coupling is established between the resonators opposing each other in the first direction, i.e., the second resonator 12 in the first substrate 10 and the first resonator 21 in the second substrate 20, thereby forming the second resonance section 2. The first resonance section 1 is configured only by the first resonator 11 inside of the first substrate 10. The third resonance section 3 is configured only by the second resonator 22 inside of the second substrate 20. In the state that the first and second substrates 10 and 20 are opposing each other in the first direction, the first resonator 11 in the first substrate 10 resonates at the predetermined first resonance frequency f1 (or the second resonance frequency f2). Also in the state that the first and second substrates 10 and 20 are disposed away enough from each other so as not to establish electromagnetic coupling therebetween, the first resonator 11 also resonates at the predetermined first resonance frequency f1 (or the second resonance frequency f2). Similarly, in the state that the first and second substrates 10 and 20 are opposing each other in the first direction, the second resonator 22 in the second substrate 20 resonates at the predetermined first resonance frequency f1 (or the second resonance frequency f2). Also in the state that the first and second substrates 10 and 20 are disposed away enough from each other so as not to establish electromagnetic coupling therebetween, the second resonator 22 also resonates at the predetermined first resonance frequency f1 (or the second resonance frequency f2).

As such, even if only one resonance section configures a coupled resonator in the hybrid resonance mode, due to the effects of the resonance section, signal transmission is performed in a predetermined passband including a predetermined resonance frequency when a plurality of substrates are electromagnetically coupled to one another. On the other hand, when the substrates are disposed away enough from one another so as not to establish electromagnetic coupling thereamong, signal transmission is not performed in the predetermined passband, thereby being able to prevent any leakage of signals (electromagnetic waves) from the resonators formed to the substrates when the substrates are separated away enough from each other.

Eighth Embodiment

Described next is a signal transmission device in an eighth embodiment of the present disclosure. Herein, any component part substantially the same as that of the signal transmission device in the first to seventh embodiments described above is provided with the same reference numeral, and is not described again if appropriate.

Figure 27:
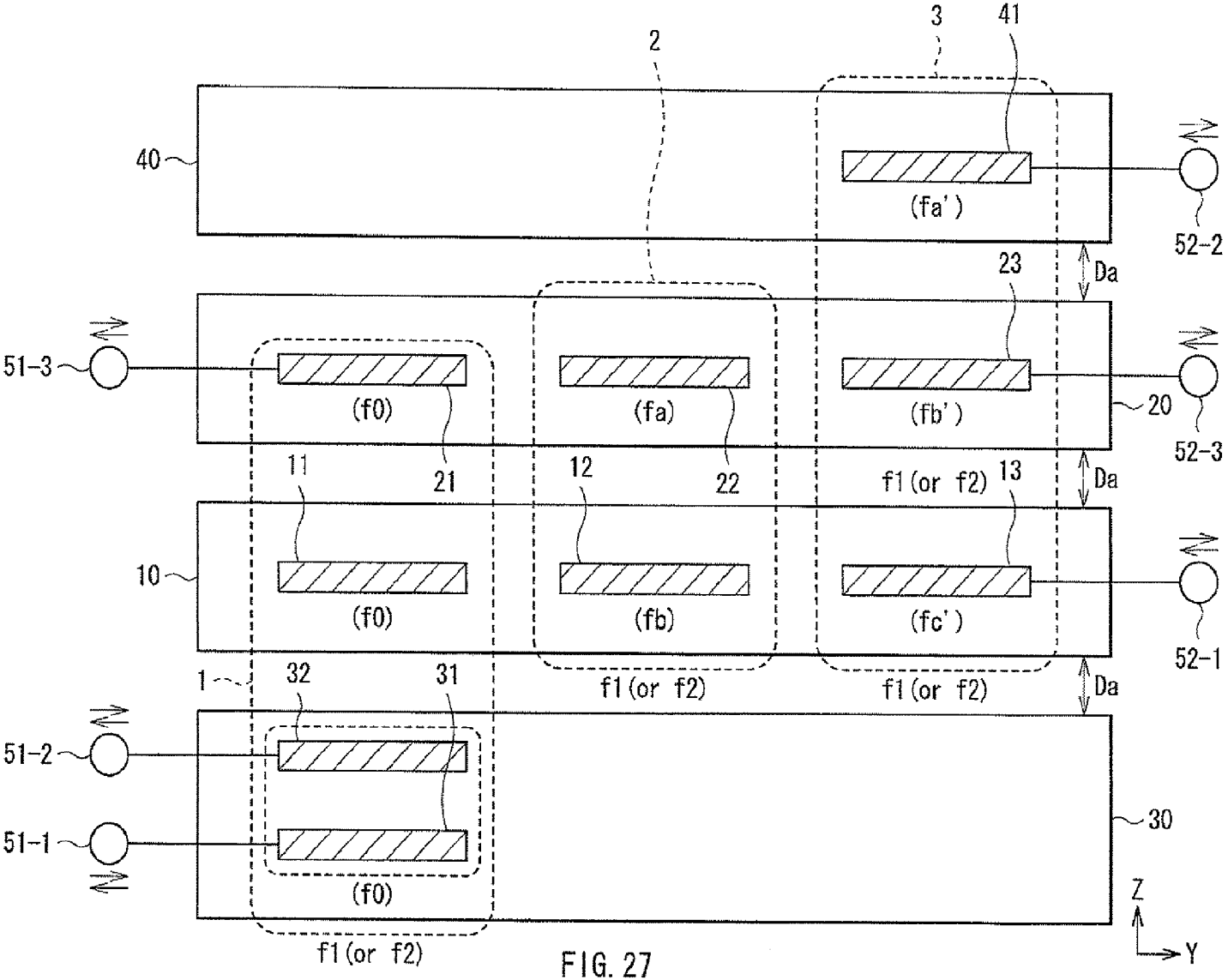
FIG. 27 is a cross-sectional view of a signal transmission device in an eighth embodiment of the present disclosure, showing an exemplary configuration thereof together with a resonance frequency of each substrate component.

In the embodiments described above, exemplified is the configuration of including the two input/output terminals 51 and 52. Alternatively, three or more input/output terminals may be provided. FIG. 27 shows an example of such a configuration of including three first input/output terminals 51-1, 51-2, and 51-3, and three second input/output terminals 52-1, 52-2, and 52-3.

In the exemplary configuration of FIG. 27, similarly to the exemplary configuration of FIG. 25, four substrates 10, 20, 30, and 40 are provided. The first substrate 10 is formed therein with the first, second, and third resonator 11, 12, and 13. The second substrate 20 is formed therein with the first, second, and third resonators 21, 22, and 23. The third substrate 30 is formed therein with the first and second resonators 31 and 32 in layer in the first direction. The fourth substrate 40 is formed therein with only the first resonator 41.

In the exemplary configuration of FIG. 27, in the state that the substrates are opposing one another in the first direction, electromagnetic coupling is established between the resonators opposing each other in the first direction, i.e., the first resonator 11 in the first substrate 10 and the second resonator 32 in the third substrate 30, and electromagnetic coupling is established between the resonators opposing each other also in the first direction, i.e., the first resonator 11 in the first substrate 10 and the first resonator 21 in the second substrate 20, thereby forming the first resonance section 1. Also in the state that the substrates are opposing one another in the first direction, electromagnetic coupling is established between the resonators opposing each other in the first direction, i.e., the second resonator 12 in the first substrate 10 and the second resonator 22 in the second substrate 20, thereby forming the second resonance section 2. Also in the state that the substrates are opposing one another in the first direction, electromagnetic coupling is established between the resonators opposing each other in the first direction, i.e., the third resonator 13 in the first substrate 10 and the third resonator 23 in the second substrate 20, and electromagnetic coupling is established between the resonators opposing each other also in the first direction, i.e., the third resonator 23 in the second substrate 20 and the first resonator 41 in the fourth substrate 40, thereby forming the third resonance section 3. As such, in the state that the substrates are opposing one another in the first direction, the first, second, and third resonance sections 1, 2, and 3 are disposed in parallel to each other in the second direction.

One of the three first input/output terminals, i.e., the first input/output terminal 51-1, is connected directly to the first resonator 31 in the third substrate 30, i.e., electrical continuity is directly established therebetween. One of the remaining two first input/output terminals, i.e., first input/output terminal 51-2, is connected directly to the second resonator 32 in the third substrate 30. The remaining first input/output terminal 51-3 is connected directly to the first resonator 21 in the second substrate 20.

One of the three second input/output terminals, i.e., the second input/output terminal 52-1, is connected directly to the third resonator 13 in the first substrate 10. One of the remaining two second input/output terminals, i.e., second input/output terminal 52-2, is directly connected to the first resonator 41 in the fourth substrate 40.

In this exemplary configuration, in the state that the substrates are opposing one another in the first direction, electromagnetic coupling is established among the resonance sections at the predetermined first resonance frequency (or the second resonance frequency f2). Therefore, no matter from which input/output terminal signals are provided, i.e., the three first input/output terminals 51-1, 51-2, and 51-3, and the three second input/output terminals 52-1, 52-2, and 52-3, the signals are to be transmitted to any other arbitrary terminal(s). Especially when signals are input/output using the first input/output terminal 51-3, and the second input/output terminal 52-3, signal transmission is to be possibly performed in the same substrate, i.e., in the second substrate 20 in this case.

Ninth Embodiment

Described next is a signal transmission device in a ninth embodiment of the present disclosure. Herein, any component part substantially the same as that of the signal transmission device in the first to eighth embodiments described above is provided with the same reference numeral, and is not described again if appropriate.

In the embodiments described above, exemplified is the configuration in which two or more resonance sections (coupled resonators) are disposed in parallel to each other in the state that a plurality of substrates are opposing one another. Alternatively, only one resonance section (coupled resonator) may be connected with filter member such as LPF (Low-Pass Filter). If this is the configuration, the filter member is preferably provided at least on the output end of signals.

Figure 28:
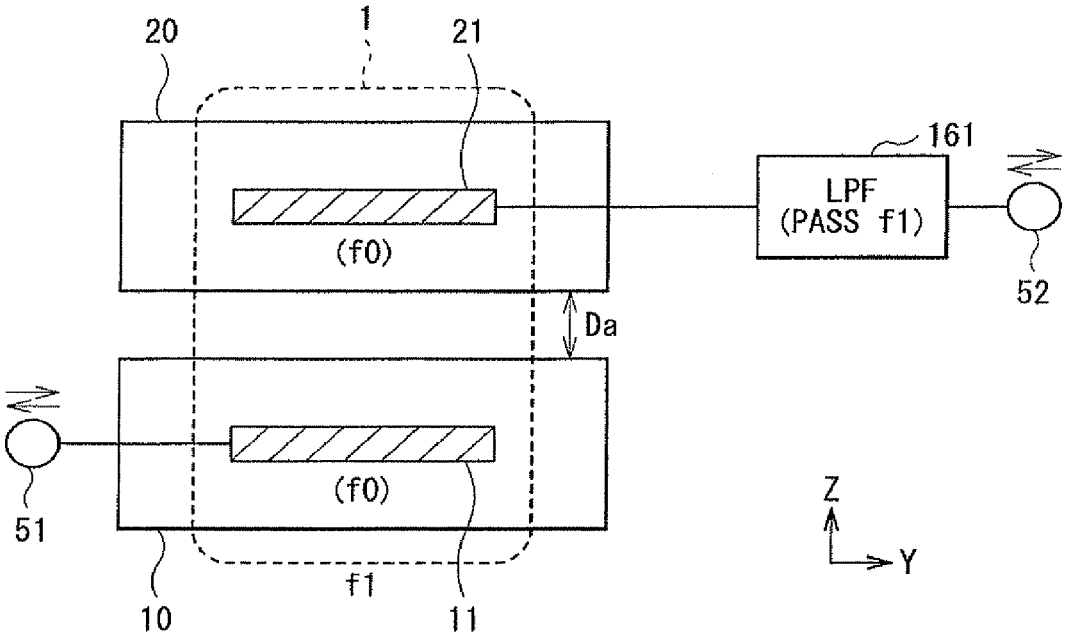
FIG. 28 is a cross-sectional view of a signal transmission device in a ninth embodiment of the present disclosure, showing a first exemplary configuration thereof together with a resonance frequency of each substrate component.

FIG. 28 shows an exemplary first configuration of a signal transmission device in this embodiment. The signal transmission device in this example of the first configuration does not include the second resonance section 2 (second resonators 12 and 22) in the signal transmission device of FIG. 1, but additionally includes an LPF 161 as the filter member. The LPF 161 is connected to the second input/output terminal 52 side (the first resonator 21 in the second substrate 20). In this signal transmission device, as a predetermined resonance frequency, in the first resonance section 1, the range including the lower frequency in the hybrid resonance mode, i.e., the first resonance frequency f1, is a passband for signals. The LPF 161 is a filter member that allows the passage of signals of a predetermined passband including the first resonance frequency f1 as the predetermined resonance frequency, and interrupts the passage of signals of any other resonance frequency not in the range of the predetermined passband, i.e., the resonance frequency f0 for each of the resonators 11 and 21 when no electromagnetic coupling is established. In this signal transmission device, in the state that the first and second substrates 10 and 20 are disposed away enough from each other so as not to establish electromagnetic coupling therebetween, signal transmission is not performed at the first or second resonance frequency f1 being the passband for signals because the resonators 11 and 21 each resonate at the resonance frequency f0 when no electromagnetic coupling is established. Moreover, also in this state, even if signals of the resonance frequency f0 are provided to the second input/output terminal 52 side, the signals of the resonance frequency f0 are to be reflected by the LPF161. Moreover, the LPF 161 interrupts also the output of signals of the resonance frequency f0 from the first resonator 21 in the second substrate 20 to the second input/output terminal 52 side. Accordingly, any leakage of signals (electromagnetic waves) from the resonators 11 and 21 is favorably prevented with more effect.

Figure 29:
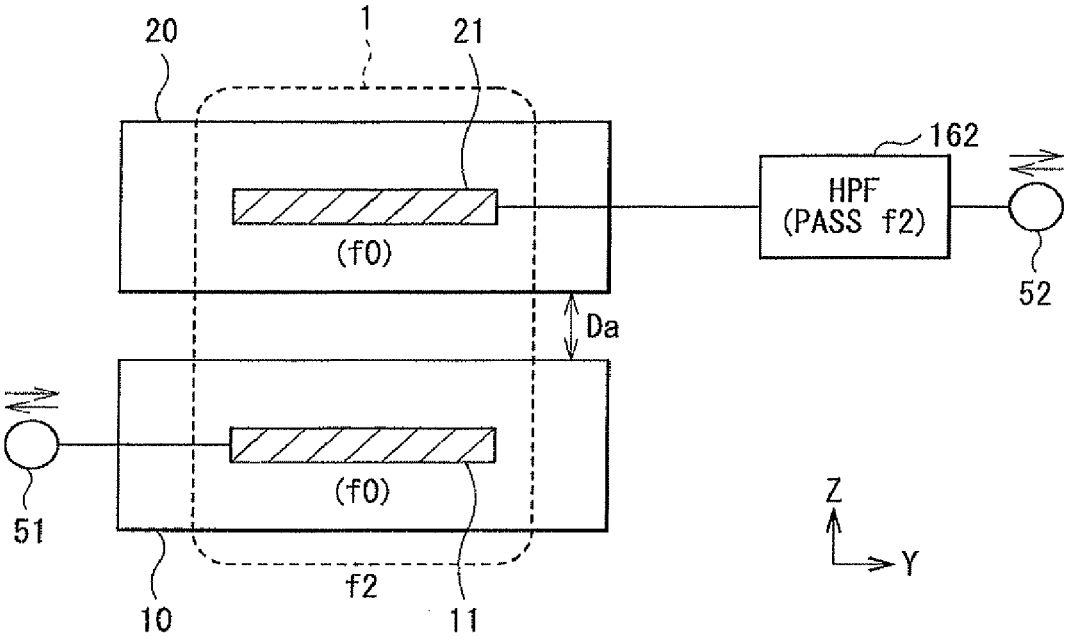
FIG. 29 is a cross-sectional view of the signal transmission device in the ninth embodiment of the present disclosure, showing a second exemplary configuration thereof together with a resonance frequency of each substrate component.

FIG. 29 shows an exemplary second configuration of a signal transmission device in this embodiment. The signal transmission device in this example of the second configuration does not include the second resonance section 2 (second resonators 12 and 22) in the signal transmission device of FIG. 1, but additionally includes an HPF (High-Pass Filter) 162 as the filter member. The HPF 162 is connected to the second input/output terminal 52 side (the first resonator 21 in the second substrate 20). In this signal transmission device, as a predetermined resonance frequency, in the first resonance section 1, the range including the higher frequency in the hybrid resonance mode, i.e., the second resonance frequency f2, is a passband for signals. The HPF 162 is filter member that allows the passage of signals of a predetermined passband including the second resonance frequency f2 as the predetermined resonance frequency, and interrupts the passage of signals of any other resonance frequency not in the range of a predetermined passband, i.e., the resonance frequency f0 for each of the resonators 11 and 21 when no electromagnetic coupling is established. In this signal transmission device, in the state that the first and second substrates 10 and 20 are disposed away enough from each other so as not to establish electromagnetic coupling therebetween, signal transmission is not performed at the second resonance frequency f2, i.e., the passband for signals, because the resonators 11 and 21 each resonate at the resonance frequency f0 when no electromagnetic coupling is established. Moreover, also in this state, even if signals of the resonance frequency f0 are input to the second input/output terminal 52 side, the signals of the resonance frequency f0 are to be reflected by the HPF 162. Moreover, the HPF 162 interrupts also the output of signals of the resonance frequency f0 from the first resonator 21 in the second substrate 20 to the second input/output terminal 52 side. Accordingly, any leakage of signals (electromagnetic waves) from the resonators 11 and 21 is favorably prevented with more effect.

Figure 30:
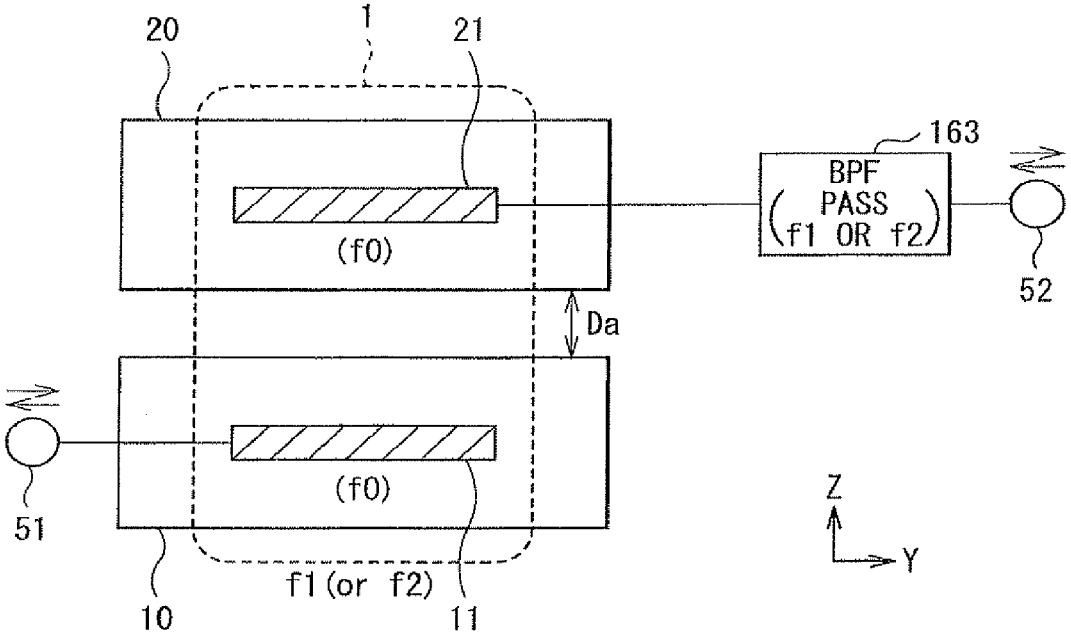
FIG. 30 is a cross-sectional view of the signal transmission device in the ninth embodiment of the present disclosure, showing a third exemplary configuration thereof together with a resonance frequency of each substrate component.

FIG. 30 shows an exemplary third configuration of a signal transmission device in this embodiment. The signal transmission device in this example of the third configuration does not include the second resonance section 2 (second resonators 12 and 22) in the signal transmission device of FIG. 1, but additionally includes a BPF (Band-Pass Filter) 163 as the filter member. The BPF 163 is connected to the second input/output terminal 52 side (the first resonator 21 in the second substrate 20). In this signal transmission device, as a predetermined resonance frequency, in the first resonance section 1, the range including the first or second resonance frequency f1 or f2 in the hybrid resonance mode is a passband for signals. The BPF 163 is a filter member that allows the passage of signals of a predetermined passband including the first or second resonance frequency f1 or f2 as the predetermined resonance frequency, and interrupts the passage of signals of any other resonance frequency not in the range of the predetermined passband, i.e., the resonance frequency f0 for each of the resonators 11 and 12 when no electromagnetic coupling is established. In this signal transmission device, in the state that the first and second substrates 10 and 20 are disposed away enough from each other so as not to establish electromagnetic coupling therebetween, signal transmission is not performed at the first or second resonance frequency f1 or f2, i.e., the passband for signals, because the resonators 11 and 12 each resonate at the resonance frequency f0 when no electromagnetic coupling is established. Moreover, also in this state, even if signals of the resonance frequency f0 are input to the second input/output terminal 52 side, the signals of the resonance frequency f0 are to be reflected by the BPF 163. Moreover, the BPF 163 interrupts also the output of signals of the resonance frequency f0 from the first resonator 21 in the second substrate 20 to the first input/output terminal 51 side. Accordingly, any leakage of signals (electromagnetic waves) from the resonators 11 and 12 is favorably prevented with more effect.

Figure 31:
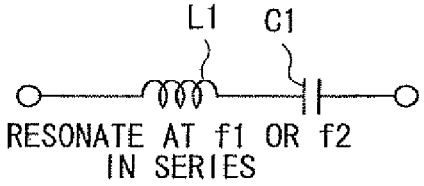
FIG. 31 is a circuit diagram showing an exemplary bandpass filter being a series resonance circuit.

FIG. 31 is an exemplary first configuration of the BPF 163. In this exemplary first configuration, the BPF 163 is an LC resonator circuit of series resonance type, in which a capacitor C1 and an inductor L1 are connected together in series. With this LC resonator circuit, series resonance occurs at the first or second resonance frequency f1 or f2.

Figure 32:
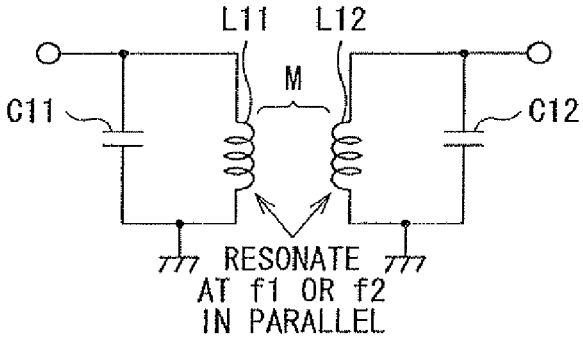
FIG. 32 is a circuit diagram showing an exemplary bandpass filter being a parallel resonance circuit.

FIG. 32 shows an exemplary second configuration of the BPF 163. In this exemplary second configuration, the BPF 163 is an LC resonator circuit of parallel resonance type, in which first and second LC resonator circuits are disposed in parallel for coupling with a magnetic field M. The first LC resonator circuit is the one configured by a first capacitor C11 and a first inductor L11, and the second LC resonator circuit is the one configured by a second capacitor C12 and a second inductor L12. With this LC resonator circuit, parallel resonance occurs at the first or second resonance frequency f1 or f2.

Note that, in FIGS. 28 to 30, exemplified is the case of connecting the filter member such as the LPF 161 to the second input/output terminal 52 side, i.e., the first resonator 21 in the second substrate 20. Alternatively, the filter member may be connected to the first input/output terminal 51 side, i.e., the first resonator 11 in the first substrate 10. Still alternatively, the filter member may be connected to both the sides of the first and second input/output terminals 51 and 52.

FIGS. 28 to 30 show the examples in which the filter member is the LPF (Low-Pass Filter), the HPF (High-Pass Filter), the BPF (Band-Pass Filter). Alternatively, the filter member may be a BEF (Band-Elimination Filter) for interrupting signals of the resonance frequency f0 for each of the resonator when no electromagnetic coupling is established. The filter member serves the purpose as long as it allows passage of signals of a predetermined passband including a predetermined resonance frequency, and interrupts the passage of signals of any other resonance frequency not in the range of a predetermine passband, i.e., the resonance frequency f0 for each of the resonators when no electromagnetic coupling is established.

Still further, FIGS. 28 to 30 show the examples in which the filter member is connected outside of the substrate. Alternatively, the filter member may be formed inside of the substrate.

Other Embodiments

While the present disclosure has been described in detail, the foregoing description is in all aspects illustrative and not restrictive, and numerous other modifications and variations are possibly devised.

As an example, the signal transmission device of each embodiment described above is not only available for signal transmission, i.e., transmission/reception of analog or/and digital signals, but also available as a power transmission device for transmission/reception of power.

The present disclosure contains subject matter related to that disclosed in Japanese Patent Application JP 2010-194558 filed in the Japan Patent Office on Aug. 31, 2010, and that in Japanese Priority Patent Application JP 2010-267139 filed on Nov. 30, 2010, the entire content of which is hereby incorporated by reference.

What is claimed is:

1. A signal transmission device, comprising:

a plurality of substrates opposing one another along a first direction;

plural resonators; and a plurality of resonance sections in a parallel arrangement along a second direction different from the first direction, any of the resonance sections adjacent to each other perform signal transmission in a predetermined passband including a predetermined resonance frequency through electromagnetic coupling therebetween by each resonating at the predetermined resonance frequency, wherein at least one of the substrates is formed with two or more resonators of the plural resonators in the second direction, and the remaining one or two or more of the substrates are each formed with one or more resonators of the plural resonators in the second direction, and at least one of the resonance sections is configured by a plurality of resonators of the plural resonators opposing one another in the first direction between the substrates, the plurality of resonators comprising at least two resonators, the at least two resonators being from different substrates, the opposing resonators form a coupled resonator resonating as a whole at the predetermined resonance frequency through electromagnetic coupling in a hybrid resonance mode, and in a state that the substrates are separated away from one another to fail to establish electromagnetic coupling thereamong, the resonators forming the coupled resonator resonate at any other resonance frequency different from the predetermined resonance frequency for each substrate, and the predetermined passband does not include the any other resonance frequency different from the predetermined resonance frequency.

2. The signal transmission device according to claim 1, further comprising:

a first input/output terminal connected directly physically at least to a first resonator of the plurality of resonators, the first resonator configuring a first resonance section among the resonance sections, or electromagnetically coupled to the first resonator with a spacing therefrom; and a second input/output terminal connected directly physically at least to a second resonator of the plurality of resonators, the second resonator configuring any of the resonance sections other than the first resonance section, or electromagnetically coupled to the second resonator with a spacing therefrom, wherein in the state that the substrates are opposing each other in the first direction, signal transmission is performed between the substrates or in each of the substrates.

3. The signal transmission device according to claim 2, wherein the first input/output terminal is connected with a filter member allowing passage of a signal of the predetermined passband, and interrupting passage of a signal of the other resonance frequency out of a range of the predetermined passband.

4. The signal transmission device according to claim 1, wherein in the state that the substrates are separated away from each other to fail to establish electromagnetic coupling thereamong, the resonators forming the coupled resonator all resonate at the other resonance frequency for each substrate.

5. The signal transmission device according to claim 1, wherein in any of the substrates formed with the two or more resonators in the second direction, the resonators of the two or more resonators that are adjacent to each other resonate at each different resonance frequency when no electromagnetic coupling is established therebetween.

6. The signal transmission device according to claim 1, wherein among the resonance sections, a first resonance section and a second resonance section of the plurality of resonance sections each form the coupled resonator, and the resonators configuring the first resonance section and the resonators configuring the second resonance section are formed in two or more substrates of the plurality of substrates in a same combination.

7. The signal transmission device according to claim 1, wherein among the resonance sections, a first resonance section and a second resonance section each form the coupled resonator, the first and second resonance sections are adjacent to each other in the second direction, and the resonators configuring the first resonance section and the resonators configuring the second resonance section are formed in the substrates in a partially different combination.

8. A filter provided with the signal transmission device of claim 1.

9. An inter-substrate communication device provided with the signal transmission device of claim 1, wherein in the state that the substrates are opposing each other in the first direction, signal transmission is performed between the substrates.

* * * * *